US009621986B2

(12) United States Patent
Oh et al.

(10) Patent No.: US 9,621,986 B2
(45) Date of Patent: Apr. 11, 2017

(54) ELECTRONIC DEVICE, AUDIO DEVICE, AND METHOD FOR SUPPLYING POWER TO THE AUDIO DEVICE

(71) Applicant: Samsung Electronics Co., Ltd., Suwon-si, Gyeonggi-do (KR)

(72) Inventors: Min-Woo Oh, Suwon-si (KR); Byoung-Hee Lee, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 153 days.

(21) Appl. No.: 14/471,382

(22) Filed: Aug. 28, 2014

(65) Prior Publication Data

US 2015/0271595 A1 Sep. 24, 2015

(30) Foreign Application Priority Data

Mar. 24, 2014 (KR) ..... 10-2014-0034294

(51) Int. Cl.
*H04R 3/00* (2006.01)
*H04R 29/00* (2006.01)

(52) U.S. Cl.
CPC ..... *H04R 3/00* (2013.01); *G10H 2230/035* (2013.01); *H04R 29/004* (2013.01)

(58) Field of Classification Search
None
See application file for complete search history.

(56) References Cited

U.S. PATENT DOCUMENTS

2007/0036367 A1 2/2007 Ko
2007/0177741 A1* 8/2007 Williamson ..... H04R 1/1083 381/71.6
2008/0175402 A1* 7/2008 Abe ..... G10K 11/178 381/71.6
2010/0061565 A1* 3/2010 Saraoka ..... G10K 11/178 381/71.6
2011/0128019 A1* 6/2011 Saito ..... H04R 5/04 324/713
2012/0148062 A1* 6/2012 Scarlett ..... G10K 11/1788 381/71.6
2013/0336506 A1* 12/2013 Prentice ..... H04R 3/00 381/309
2014/0100001 A1* 4/2014 Im ..... H04M 1/6058 455/570

FOREIGN PATENT DOCUMENTS

EP 2654168 A1 * 10/2013 ..... H02J 7/0044
KR 10-2007-0075664 A 7/2007

* cited by examiner

*Primary Examiner* — Paul Huber
(74) *Attorney, Agent, or Firm* — Jefferson IP Law, LLP

(57) ABSTRACT

An apparatus and method for supplying power to an audio device is provided. An electronic device includes an audio device connector comprising a microphone terminal configured to receive an audio signal of a microphone from an audio device, at least one audio terminal configured to output the audio signal to the audio device, a ground terminal, a power supply unit configured to selectively generate one of a first power and a second power to be supplied to the audio device through the microphone terminal, and a controller configured to identify whether the audio device has a type that includes an additional function unit based on a voltage at the microphone terminal, and to control the power supply unit to apply one of the first power and the second power to the microphone terminal correspondingly to the type of the audio device.

7 Claims, 11 Drawing Sheets

ELECTRONIC DEVICE, AUDIO DEVICE, AND METHOD FOR SUPPLYING POWER TO THE AUDIO DEVICE

CROSS-REFERENCE TO RELATED APPLICATION(S)

This application claims the benefit under 35 U.S.C. §119 (a) of a Korean patent application filed on Mar. 24, 2014 in the Korean Intellectual Property Office and assigned Serial number 10-2014-0034294, the entire disclosure of which is hereby incorporated by reference.

TECHNICAL FIELD

The present disclosure relates to an apparatus and method for supplying power to an audio device.

BACKGROUND

Audio devices like earphones, ear microphones, headphones, headsets, and the like, are connected to and used by electronic devices. An audio device may include a speaker. The audio device may also include a microphone. The audio device including the speaker and microphone may output audio received from the electronic device to the speaker or may output audio received from the microphone to the electronic device.

The audio device may further include an additional function unit, such as a radio receiver block, an Active Noise Canceling (ANC) block, and the like. The radio receiver block may be used to listen to the radio. The ANC block may be used to reduce the noise surrounding the audio device. For example, the ANC block may reduce the surrounding noise by receiving surrounding sound, performing phase inversion on an audio signal of the surrounding sound and superposing the result on the audio signal.

The microphone of the audio device may be driven by power supplied from the electronic device. To drive the microphone, the electronic device may supply power with a current of a few milliAmperes (mA) or less than 1 mA to the audio device. The additional function unit, such as the radio receiver block or the ANC block may require greater consumption current than the microphone does. To drive the ANC block, a current of a few tens mA, for example, is necessary.

An additional power line may be connected between the electronic device and the audio device in order for power to drive the additional function unit to be supplied to the audio device from the electronic device. The audio device may also include a battery to drive the additional function unit instead of being supplied with power from the electronic device.

A connection of a typical structure used to connect the electronic device and the audio device may not have an additional power line. Accordingly, with the connection of the typical structure, the electronic device may not be able to supply power to the audio device to drive the additional function unit. In the case the audio device includes a battery to drive the additional function unit, the audio device may have increased volume and weight. Furthermore, whether to drive the additional function unit of the typical audio device may not be controlled by the electronic device.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an electronic device to supply an audio device with power to drive an additional function unit of the audio device through a connection of a typical structure.

Another aspect of the present disclosure is to provide an electronic device to supply an audio device with power corresponding to whether an additional function unit is included in the audio device.

Another aspect of the present disclosure is to provide an electronic device to supply or stop supplying an audio device with power corresponding to whether an additional function unit is included in the audio device.

Another aspect of the present disclosure is to provide an electronic device to control whether to drive an additional function unit of an audio device.

Another aspect of the present disclosure is to provide an electronic device to control whether to drive an additional function unit of an audio device according to an instruction from the audio device.

In accordance with an aspect of the present disclosure, an electronic device is provided. The electronic device includes an audio device connector including a microphone terminal configured to receive an audio signal of a microphone from an audio device, at least one audio terminal configured to output an audio signal to the audio device, and a ground terminal, a power supply unit configured to selectively generate one of a first power and a second power to be supplied to the audio device through the microphone terminal, and a controller configured to identify whether the audio device has a type that includes an additional function unit based on a voltage at the microphone terminal, and control the power supply unit to apply one of the first power and the second power to the microphone terminal correspondingly to the type of the audio device.

In accordance with another aspect of the present disclosure, an electronic device is provided. The electronic device includes an audio device connector including a microphone terminal configured to receive an audio signal of a microphone from an audio device, at least one audio terminal configured to output an audio signal to the audio device, and a ground terminal, a power supply unit configured to selectively generate one of a first power and a second power to be supplied to the audio device through the microphone terminal, and a controller configured to identify an instruction as to whether to drive an additional function included in the audio device based on a voltage at the microphone terminal, and control the power supply unit to apply one of the first power and the second power to the microphone terminal correspondingly to the instruction.

In accordance with another aspect of the present disclosure, an electronic device is provided. The electronic device includes an audio device connector including a microphone terminal configured to receive an audio signal of a microphone from an audio device, at least one audio terminal configured to output an audio signal to the audio device, and a ground terminal, a first power supply unit configured to generate a first power to be supplied to the audio device through the microphone terminal, a second power supply unit configured to generate a second power to be supplied to the audio device through one of the microphone terminal and the audio terminal, and a controller configured to identify an instruction as to whether to drive an additional function included in the audio device based on a voltage at the microphone terminal, and control the second power supply unit to apply the second power to one of the microphone terminal and the audio terminal in response to an instruction to drive the additional function unit.

In accordance with another aspect of the present disclosure, a method for supplying power to an audio device in an electronic device is provided. The method includes identifying whether the audio device has a type that includes an additional function unit based on a voltage at a microphone terminal for receiving an audio signal of a microphone from the audio device, and applying one of a first power and a second power to be supplied to the audio device through the microphone terminal to the microphone terminal correspondingly to the type of the audio device.

In accordance with another aspect of the present disclosure, a method for supplying power to an audio device in an electronic device is provided. The method includes identifying an instruction as to whether to drive an additional function unit included in the audio device based on a voltage at a microphone terminal for receiving an audio signal of a microphone from the audio device, and applying one of a first power and a second power to be supplied to the audio device through the microphone terminal to the microphone terminal correspondingly to the instruction.

In accordance with another aspect of the present disclosure, a method for supplying power to an audio device in an electronic device is provided. The method includes identifying an instruction as to whether to drive an additional function unit included in the audio device based on a voltage at a microphone terminal for receiving an audio signal of a microphone from the audio device, and applying, among a first power to be supplied to the audio device through the microphone terminal and a second power to be supplied to the audio device through one of the microphone terminal and an audio terminal for outputting an audio signal to the audio device, the second power to one of the microphone terminal and the audio terminal in response to an instruction to drive the additional function unit.

In accordance with another aspect of the present disclosure, an audio device is provided. The audio device includes an electronic device connector including a microphone terminal configured to output an audio signal of a microphone from an electronic device, at least one audio terminal configured to receive an audio signal from the electronic device, and a ground terminal, an additional function unit configured to be driven by power input from the electronic device through the microphone terminal and perform an additional function, and a type setup unit configured to provide a voltage indicating that the audio device has a type that includes the additional function unit to the electronic device through the microphone terminal.

In accordance with another aspect of the present disclosure, an audio device is provided. The audio device includes an electronic device connector including a microphone terminal configured to output an audio signal of a microphone from an electronic device, at least one audio terminal configured to receive an audio signal from the electronic device, and a ground terminal, an additional function unit configured to be driven by power input from the electronic device through the microphone terminal and perform an additional function, and a driving instruction unit configured to provide a voltage indicating an instruction as to whether to drive the additional function unit to the electronic device through the microphone terminal.

In accordance with another aspect of the present disclosure, an audio device is provided. The audio device includes an electronic device connector including a microphone terminal configured to output an audio signal of a microphone from an electronic device, at least one audio terminal configured to receive an audio signal from the electronic device, and a ground terminal, an additional function unit configured to be driven by power input from the electronic device and perform an additional function, a power input unit configured to apply power input through a terminal at which a voltage greater than a set level is detected among the microphone terminal and the audio terminal to the additional function unit as driving power, and a driving instruction unit configured to provide a voltage indicating an instruction as to whether to drive the additional function unit to the electronic device through the microphone terminal.

Other aspects, advantages, and salient features of the disclosure will become apparent to those skilled in the art from the following detailed description, which, taken in conjunction with the annexed drawings, discloses various embodiments of the present disclosure

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
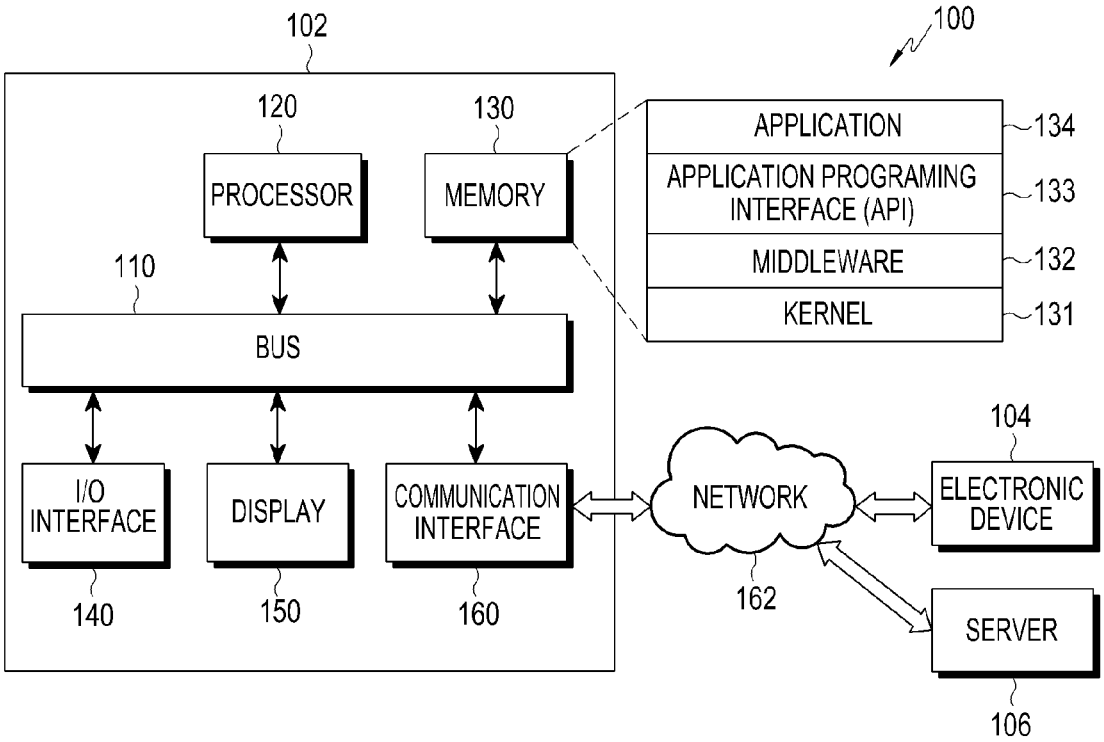
FIG. 1 illustrates a network environment including an electronic device according to an embodiment of the present disclosure.

The following with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

Ordinal numbers as herein used, such as "first", "second", etc., may modify various components of various embodiments, but do not limit those components. For example, these terms do not limit order and/or importance of corresponding elements. These terms are only used to distinguish one element from another element. For example, a first user device and a second user device refer to two different user devices although both of them are user device. For example, a first element may be named a second element without departing from the scope of the various embodiments of the present disclosure. Similarly, the second element also may be named the first element.

It should be noted that if it is described that one element is "coupled" or "connected" to another element, former element may be directly coupled or connected to latter element, but they may be coupled or connected together through at least one intervening element. Conversely, when one element is "directly coupled" or "directly connected" to another element, it may be construed that they are coupled or connected together without the intervention of some other element.

It is to be understood that the singular forms "a," "an," and "the" include plural references unless the context clearly dictates otherwise. Thus, for example, reference to "a component surface" includes reference to one or more of such surfaces.

Unless otherwise defined, all terms including technical and scientific terms used herein have the same meaning as commonly understood by one of ordinary skill in the art to which the various embodiments of the present disclosure belong. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

For example, the electronic device in accordance with various embodiments of the present disclosure may include at least one of smart phones, tablet Personal Computers (PCs), mobile phones, video phones, e-book readers, laptop PCs, netbook computers, Personal Digital Assistants (PDAs), Portable Multimedia Players (PMPs), Moving Picture Experts Group (MPEG-1) audio layer-3 (MP3) players, mobile medical devices, cameras, and wearable devices (e.g., Head-Mounted Devices (HMDs) such as electronic glasses, electronic clothes, electronic bracelets, electronic necklaces, electronic accessories, electronic tattoos, or smart watches).

In some various embodiments, the electronic device may be a smart home appliance. The smart home appliance may include at least one of televisions, Digital Video Disc (DVD) players, audio systems, refrigerators, air conditioners, cleaning machines, ovens, microwaves, washing machines, air purifiers, set-top boxes, TV sets (e.g., Samsung HomeSync™, Apple TV™, or Google TV™), game consoles, electronic dictionaries, electronic keys, camcorders, and electronic albums.

In some various embodiments, the electronic device may include at least one of a variety of medical equipment (e.g., Magnetic Resonance Angiography (MRA), Magnetic Resonance Imaging (MRI), Computed Tomography (CT), photographing device, ultrasonic device, etc.), navigation devices, Global Positioning System (GPS) receivers, Event Data Recorders (EDRs), Flight Data Recorders (FDRs), car infotainment devices, marine electronic devices (e.g., marine navigation systems, gyro-compass, and the like), avionics, security devices, car head units, industrial or home robots, banking agency's Automatic Teller Machines (ATMs), or Point of Sales (POSs) for shops.

In some various embodiments, the electronic device may include at least one of furniture or building/part of a structure including a communication capability, electronic boards, electronic signature receiving devices, projectors, or various measuring instruments (e.g., meters for water, electricity, gas, or radio waves).

The electronic device in accordance with various embodiments of the present disclosure may be one or more combinations of the aforementioned devices. In addition, the electronic device in accordance with various embodiments of the present disclosure may be a flexible device. It will be obvious to a person of ordinary skill in the art that the electronic device is not limited to the aforementioned examples.

An audio device in accordance with various embodiments of the present disclosure may include at least one of for example, an ear microphone, a headphone, and a headset. It will be obvious to a person of ordinary skill in the art that the audio device is not limited to the ear microphone, the headphone, or a headset.

FIG. 1 illustrates a network environment including an electronic device according to an embodiment of the present disclosure.

Referring to FIG. 1, in a network environment 100 an electronic device 102 may include a bus 110, a processor 120, a memory 130, an Input/Output (I/O) interface 140, a display 150, and a communication interface 160. The bus 110 may be a circuitry for interconnecting the enumerated elements of the electronic device 102 and delivering communications (e.g., control messages) among them.

The processor 120 may, for example, receive requests and/or commands from the enumerated elements, for example, the memory 130, the I/O interface 140, the display 150, the communication interface 160, and/or the like via the bus 110, interpret the requests and/or commands, and perform an operation and/or data processing according to the interpreted request or command.

The memory 130 may store a command and/or data received from the processor 120 or other elements, for example, the input/output interface 140, the display 150, the communication interface 160, the sensor module 170, and the like, or may store command and/or data generated by the processor 120 or other elements. The memory 130 may include, for example, programming modules, such as kernel 131, middleware 132, Application Programming Interface (API) 133, application 134, and the like. Each of the programming modules may be implemented in software, firmware, hardware, or two or more combinations thereof.

The kernel 131 may control or manage system resources (e.g., the bus 110, the processor 120, the memory 130, and the like) to be used to carry out an operation and/or function implemented by the other programming modules (e.g., the middleware 132, the API 133, or the application 134). Furthermore, the kernel 131 may provide an interface for the middleware 132, the API 133, or the application 134 to access respective elements of the electronic device 102 to control or manage them.

The middleware 132 may act as intermediary for the API 133 or the application 134 to communicate data with the kernel 131. In addition, the middleware 132 may perform control operations (e.g., scheduling or load balancing) in response to a task request received from the application 134 by way of placing a high priority on at least one application included in the application 134 to use system resources (e.g., the bus 110, the processor 120, the memory or the like) of the electronic device 101.

The API 133 is an interface for the application 134 to control a function provided from the kernel 131 or the middleware 132, and may include at least one interface or function (e.g., an instruction) for file control, window control, image processing, text control, and the like.

In accordance with various embodiments, the application 134 may include a Short Message Service (SMS)/Multimedia Message Service (MMS) application, an email application, a calendar application, an alarm application, a healthcare application (e.g., an application for measuring quantity of motion or blood sugar), or environmental information application (e.g., an application for providing atmospheric pressure, humidity, or temperature). Additionally or alternatively, the application 134 may be an application involved in information exchange between the electronic device 102 and an external electronic device, for example, an electronic device 104. The application involved in such information exchange may include, for example, a notification relay application for relaying particular information to an external electronic device or a device management application for managing an external electronic device.

For example, the notification relay application may include a functionality for notifying the external electronic device, for example, the electronic device 104 of notification information generated in any other application (e.g., the SMS/MMS application, the email application, the healthcare application, or the environmental information application) of the electronic device 102. Additionally or alternatively, the notification relay application may, for example, receive the notification information from the external electronic device, for example, the electronic device 104 and provide the notification information to the user. The device management application may manage (for example, install, delete, or update), for example, a function of at least a part of an external electronic device (for example, the electronic device 104) that communicates with the electronic device 102 (for example, activating/deactivating the external electronic device (or a few components) or adjusting brightness (or resolution) of a display), an application operated in the external electronic device, or a service provided from the external electronic device (for example, a call service or a message service).

In accordance with various embodiments of the present disclosure, the application 134 may include an application designated depending on an attribute (for example, a type of electronic device) of an external electronic device (for example, the electronic device 104). For example, in case the external electronic device is an MP3 player, the application 134 may include an application related to music replay. Similarly, in case the external electronic device is a mobile medical device, the application 134 may include an application related to healthcare. In accordance with an embodiment of the present disclosure, the application 134 may include at least one of applications received from an application designated for the electronic device 102 or an application received from an external electronic device (for example, the server 106 or the electronic device 104).

The I/O interface 140 may deliver instructions or data entered by the user through the I/O device (e.g., a sensor, a keyboard, or a touch screen) to the processor 120, the memory 130, or the communication interface 160, for example, via the bus 110. For example, the I/O interface 140 may provide data for a user touch input through the touch screen to the processor 120. The I/O interface 140 may also output a command or data received from the processor 120, the memory 130, or the communication interface 160 via the bus 110 through the I/O device (e.g., a speaker or the display). The I/O interface 140 may include an audio module. The audio device, such as the earphone, ear microphone, headphone, or headset may be connected to the audio module.

The display 150 may display various information (e.g., multimedia data or text data) for the user.

The communication interface 160 may connect communication between the electronic device 102 and an external electronic device (e.g., the electronic device 104 or the server 106). For example, the communication interface 160 may be connected to a network 162 through wired or wireless communication and may communicate with an external device. The wireless communication may include at least one of Wi-Fi, BT, Near Field Communication (NFC), GPS, or cellular communication (e.g., Long Term Evolution (LTE), LTE-Advanced (LTE-A), Code Division Multiple Access (CDMA), Wideband CDMA (WCDMA), Universal Mobile Telecommunication System (UMTS), Wireless Broadband (Wibro) or Global System for Mobile Communications (GSM)).

The wired communication may include at least one of Universal Serial Bus (USB), High Definition Multimedia Interface (HDMI), Recommended Standard (RS) 232 or Plain Old Telephone Service (POTS).

In accordance with an embodiment, the network 162 may be a telecommunications network. The telecommunications network may include at least one of computer network, Internet, Internet of things, or telephone network.

In accordance with an embodiment, a protocol (e.g., a transport layer protocol, a data link layer protocol or a physical layer protocol) for communication between the electronic device 102 and the external device may be supported by at least one of the application 134, the API 133, the middleware 132, the kernel 131 or the communication interface 160.

In accordance with an embodiment, a controller may include a processor 120 and a memory 130 for storing information required by the processor 120. The controller, which is a central processing unit, may control general operations of the electronic device 102 and perform operations of a method for supplying power to the audio device as will be discussed later in accordance with various embodiments of the present disclosure.

In the following various embodiments an ear microphone will be taken as an example of the audio device, but the audio device is not limited to the ear microphone. Also, an Active Noise Canceling (ANC) block will be taken as an example of an additional function unit included in the audio device, but the additional function unit is not limited to the ANC block.

Figure 2:
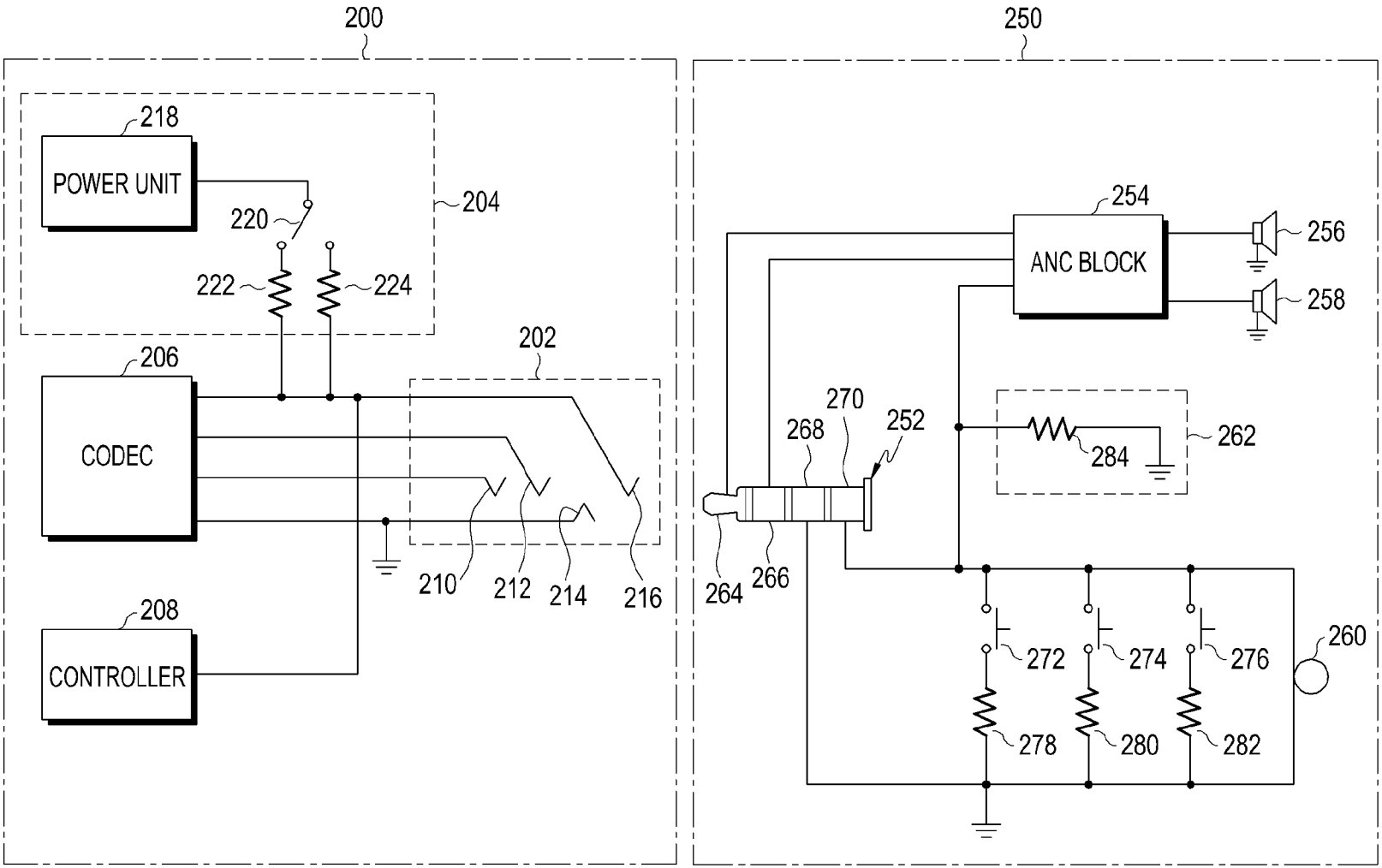
FIGS. 2, 3, and 4 illustrate block diagrams of pairs of an electronic device and audio device to be connected to each other according to various embodiments of the present disclosure.

FIG. 2 illustrates a block diagram of a pair of an electronic device and audio device to be connected to each other according to an embodiment of the present disclosure.

Referring to FIG. 2, an audio device, for example, an ear microphone 250 may be connected to an electronic device 200. In the embodiment of FIG. 2, the electronic device 200 is connected to the ear microphone 250 through their respective 4-pole connectors each including a left (L) channel audio terminal, a right (R) channel audio terminal, a ground terminal, and a microphone terminal.

The electronic device 200 may include an audio device connector 202, a power supply unit 204, a coder-decoder (codec) 206, and a controller 208. The ear microphone 250 may include an electronic device connector 252, an ANC block 254, an L channel speaker 256, an R channel speaker 258, a microphone 260, a type setup unit 262, a volume up switch 272, a volume down switch 274, a send/end switch 276, and resistors 278, 280 and 282.

The audio device connector 202 may include an L channel audio terminal 210 for outputting an L channel audio signal to the ear microphone 250, an R channel audio terminal 212 for outputting an R channel audio signal to the ear microphone 250, a ground terminal 214, and a microphone terminal 216 for receiving an audio signal of a microphone from the ear microphone 250. The electronic device connector 252 may include an L channel audio terminal 264 for receiving an L channel audio signal from the electronic device 200, an R channel audio terminal 266 for receiving an R channel audio signal from the electronic device 200, a ground terminal 268, and a microphone terminal 270 for outputting an audio signal of a microphone to the electronic device 200.

For example, the audio device connector 202 may be implemented in a form of a jack, and the electronic device connector 202 may be implemented in a form of a plug. Once the electronic device connector 252 shaped like a plug is inserted into the audio device connector 202 shaped like a jack, the audio device connector 202 may be connected to the electronic device connector 252 such that the L channel audio terminal 210, the R channel audio terminal 212, the ground terminal 214, and the microphone terminal 216 of the audio device connector 202 correspond to the L channel audio terminal 264, the R channel audio terminal 266, the ground terminal 268, and the microphone terminal 270 of the electronic device connector 252.

The terminals 210, 212, 214 and 216 of the audio device connector 202 may be connected to the codec 206. The codec 206 may output an audio signal to the L channel audio terminal 210 and the R channel audio terminal 212 and may receive an audio signal of a microphone from the microphone terminal 216.

The power supply unit 204 may selectively generate one of first power and second power to be supplied to the ear microphone 250 through the microphone terminal 216. The first power may be used as driving power for the microphone 260, and the second power may be used as driving power for the ANC block 254.

The controller 208 may be implemented by a processor like an Application Processor (AP) that may be included in the electronic device 200. For example, the controller 208 may be implemented by the processor 120 of the electronic device 102 shown in FIG. 1.

The controller 208 may receive a voltage at the microphone terminal 216 as an input. If the controller 208 corresponds to an AP, the controller 208 may receive the voltage at the microphone terminal 216 through an Analog to Digital Converter (ADC) port. Thus, the controller 208 may recognize the voltage through the ADC port in a digital value.

The controller 208 may identify whether the ear microphone 250 has a type that includes the ANC block 254, based on the voltage at the microphone terminal 216. The controller 208 may control the power supply unit 204 to supply the microphone terminal 216 with power corresponding to the type of the ear microphone 250. If the controller 208 identifies that the ear microphone 250 has a type that does not include the ANC block 254, the controller 208 may control the power supply unit 204 to supply the first power to the microphone terminal 216. If the controller 208 identifies that the ear microphone 250 has a type that includes the ANC block 254, the controller 208 may control the power supply unit 204 to supply the second power to the microphone terminal 216.

The power supply unit 204 may include a power unit 218, a switch 220, and resistors 222 and 224. The power supply unit 204 may generate power under control of the controller 208. The power unit 218 may be a power converter, such as a Low DropOut (LDO) that generates power from a battery source of the electronic device 200. The switch 220 and resistors 222 and 224 may be connected between an output of the power unit 218 and the microphone terminal 216. The switch 220 may be controlled by the controller 208 to apply the power output by the power unit 218 to the microphone terminal 216 through one of the resistors 222 and 224. The first power corresponds to power applied to the microphone terminal 216 through the switch 220 and the resistor 222 from the power unit 218, and the second power corresponds to power applied to the microphone terminal 216 through the switch 220 and the resistor 224 from the power unit 218.

The resistor 222 may have higher resistance than the resistor 224 does. The resistor 222 may have resistance corresponding to a consumption current of the microphone 260. The resistor 224 may have resistance corresponding to a consumption current of the ANC block 254. For example, the resistance of the resistor 222 may be 2.2 kΩ and the resistance of the resistor 224 may be 100Ω. Accordingly, the second power has higher current than the first power does.

The L channel audio terminal 264, R channel audio terminal 266, and microphone terminal 270 of the electronic device connector 252 may be connected to the ANC block 254. The ANC block 254 may be driven by power input through the microphone terminal 270 from the electronic device 200. The ANC block 254 may perform ANC processing on L and R channel audio signals input through the L and R channel audio terminals 264 and 266, respectively, from the electronic device 200, and output the processing results through respective L and R channel speakers 256 and 258.

The microphone 260, a pair of the volume up switch 272 and resistor 278 connected in series, a pair of the volume down switch 274 and resistor 280 connected in series, and a pair of the send/end switch 276 and resistor 282 connected in series may be connected in parallel between the microphone terminal 270 and the ground terminal 268. The volume up switch 272, volume down switch 274, and send/end switch 276 may be automatic reset type push button switches that may be turned on if pressed, and turned off if released. The volume up switch 272 may be used as a volume up key to instruct the electronic device 200 to increase the volume. The volume down switch 274 may be used as a volume down key to instruct the electronic device 200 to decrease the volume. The send/end switch 276 may be used as a send/end key to instruct the electronic device 200 to start or stop calling.

The resistors 278, 280 and 282 may have different resistance values. For example, the resistance of the resistor 278 may be 619Ω, the resistance of the resistor 280 may be 221Ω, and the resistance of the resistor 282 may be 50Ω. Accordingly, when the volume up switch 272, volume down switch 274, and send/end switch 276 are each turned on, a corresponding voltage at the microphone terminal 216 may be different each other. Therefore, the electronic device 200 may identify a type of a turned-on switch among the volume up switch 272, volume down switch 274, and send/end switch 276 based on the voltage at the microphone terminal 216.

The type setup unit 262 may be connected to the microphone terminal 270. The type setup unit 262 may provide a voltage indicating that the ear microphone 250 has a type that includes the ANC block 254 to the electronic device 200 through the microphone terminal 270. The type setup unit 262 may include a resistor 284 connected between the microphone terminal 270 and the ground. The resistor 284 may have different resistance from resistors 278, 280 and 282.

If the ear microphone connected to the electronic device 200 does not include the resistor 284, a voltage due to the resistor 284 may not appear at the microphone terminal 216. Accordingly, the electronic device 200 may identify whether the ear microphone 250 has a type that includes the ANC block 254 based on the voltage at the microphone terminal 216.

If the controller 208 identifies that the ear microphone 250 has a type that does not includes the ANC block 254, the controller 208 may control the switch 220 to apply output power of the power unit 218 to the microphone terminal 216 through the resistor 222 as the first power. If the controller 208 identifies that the ear microphone 250 has a type that includes the ANC block 254, the controller 208 may control the switch 220 to apply output power of the power unit 218 to the microphone terminal 216 through the resistor 224 as the second power.

Figure 3:
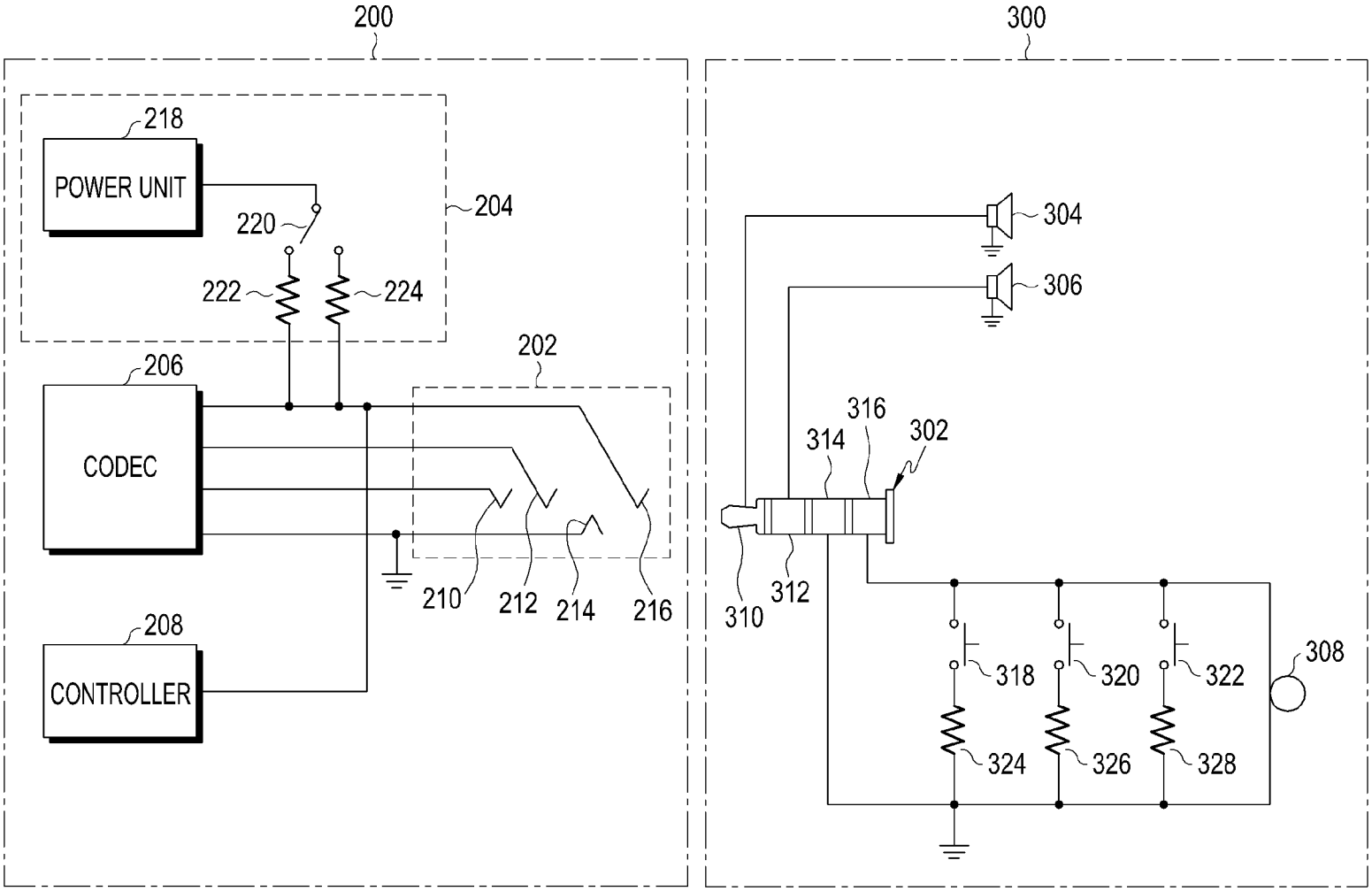

FIG. 3 illustrates a block diagram of a pair of an electronic device and audio device to be connected to each other according to an embodiment of the present disclosure.

Referring to FIG. 3, an audio device, for example, an ear microphone 300 may be connected to the electronic device 200. In the embodiment of FIG. 3, the electronic device 200 is connected to the ear microphone 300 through their respective 4-pole connectors each including a Left (L) channel audio terminal, a Right (R) channel audio terminal, a ground terminal, and a microphone terminal.

The electronic device 200 was described in connection with FIG. 2, and thus the overlapping description of the electronic device 200 will be omitted herein. Unlike the ear microphone 250 shown in FIG. 2, the ear microphone 300 has a type of audio device that does not include the ANC block 254. Thus, the ear microphone 300 does not include the type setup unit 262 as shown in FIG. 2.

The ear microphone 300 may include an electronic device connector 302, an L channel speaker 304, an R channel speaker 306, a microphone 308, a volume up switch 318, a volume down switch 320, a send/end switch 322, and resistors 324, 326 and 328. The electronic device connector 302 may include an L channel audio terminal 310, an R channel audio terminal 312, a ground terminal 314, and a microphone terminal 316.

The electronic device connector 302, L channel speaker 304, R channel speaker 306, microphone 308, volume up switch 318, volume down switch 320, send/end switch 322, and resistors 324, 326 and 328 of the ear microphone 300 may correspond to the electronic device connector 252, L channel speaker 256, R channel speaker 258, microphone 260, volume up switch 272, volume down switch 274, send/end switch 276, and resistors 278, 280 and 282 shown in FIG. 2, respectively. Thus, the same description of ear microphone 300 as that of the ear microphone 250 of FIG. 2 will be omitted herein.

Since the ear microphone 300 does not include such an ANC block, the L channel speaker 304 and R channel speaker 306 may be directly connected to the L channel audio terminal 310 and R channel audio terminal 312, respectively.

Figure 4:
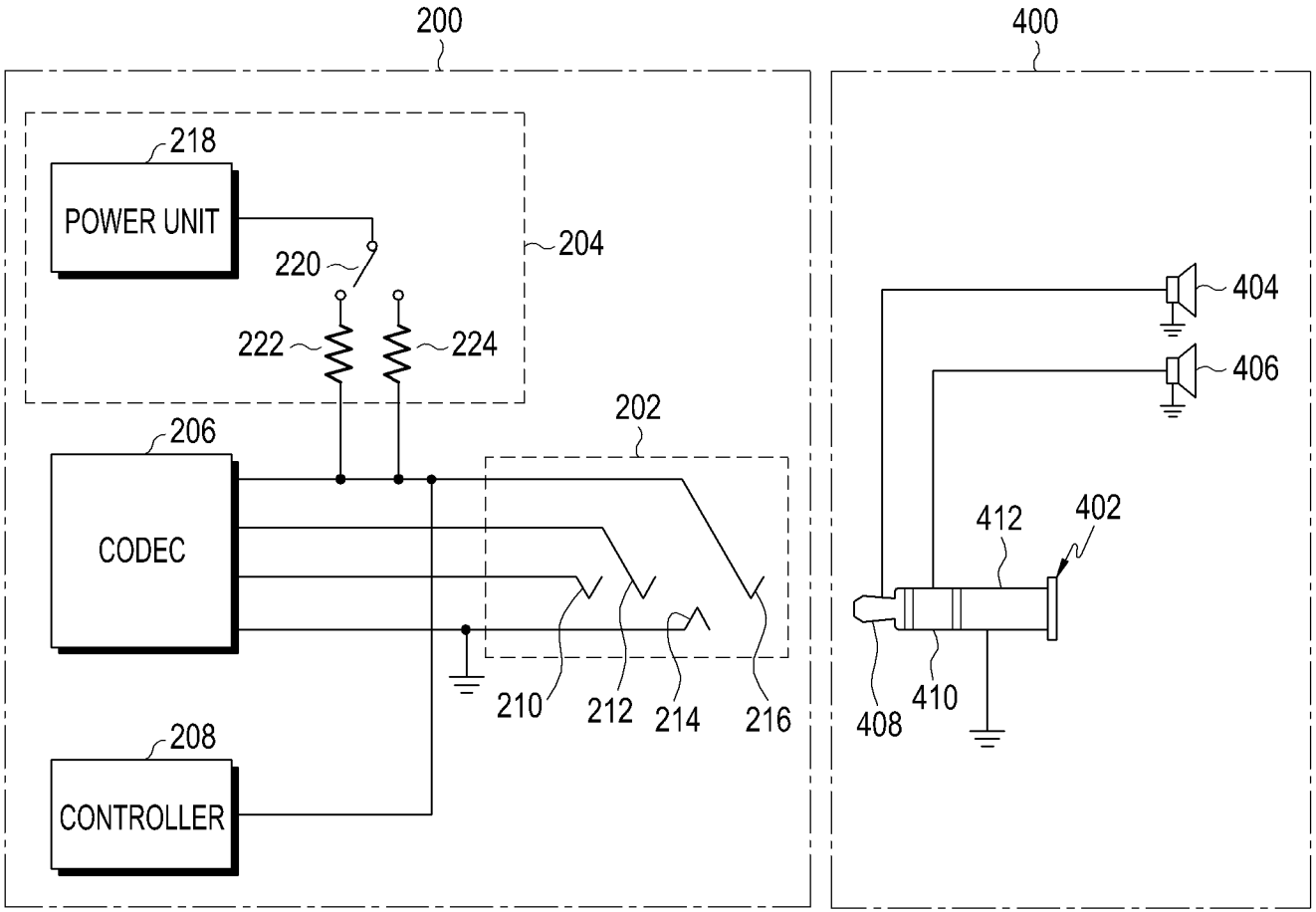

FIG. 4 illustrates a block diagram of a pair of an electronic device and audio device to be connected to each other according to an embodiment of the present disclosure.

Referring to FIG. 4, an audio device, for example, an earphone 400 may be connected to the electronic device 200. In the embodiment of FIG. 4, an occasion where the earphone 400 having a 3-pole connector 402 that includes an L channel audio terminal, R channel audio terminal and ground terminal is connected to the electronic device 200 having the 4-pole connector 202 that includes the L channel audio terminal, R channel audio terminal, ground terminal, and microphone terminal.

The electronic device 200 was described in connection with FIG. 2, and thus the overlapping description of the electronic device 200 will be omitted herein. Unlike the ear microphone 250 shown in FIG. 2, the earphone 400 has a type of audio device that does not include the ANC block 254. Thus, the earphone 400 does not include the type setup unit 262 as shown in FIG. 2.

The earphone 400 may include an electronic device connector 402, an L channel speaker 404, and an R channel speaker 406. The electronic device connector 402 may include an L channel audio terminal 408, an R channel audio terminal 410, and a ground terminal 412.

For example, once the electronic device connector 402 shaped like a plug is inserted into the audio device connector 202 shaped like a jack, the audio device connector 202 may be connected to the electronic device connector 402 such that the L channel audio terminal 210, the R channel audio terminal 212, and the ground terminal 214 of the audio device connector 202 correspond to the L channel audio terminal 408, the R channel audio terminal 410, and the ground terminal 412 of the electronic device connector 402. In the electronic device connector 402, the ground terminal 412 is formed in the place of the microphone terminal that corresponds to the microphone terminal 216 of the audio device connector 202. Accordingly, the ground terminal 214 and microphone terminal 216 of the audio device connector 202 may all be connected to the ground terminal 412 of the electronic device connector 402.

Figure 5:
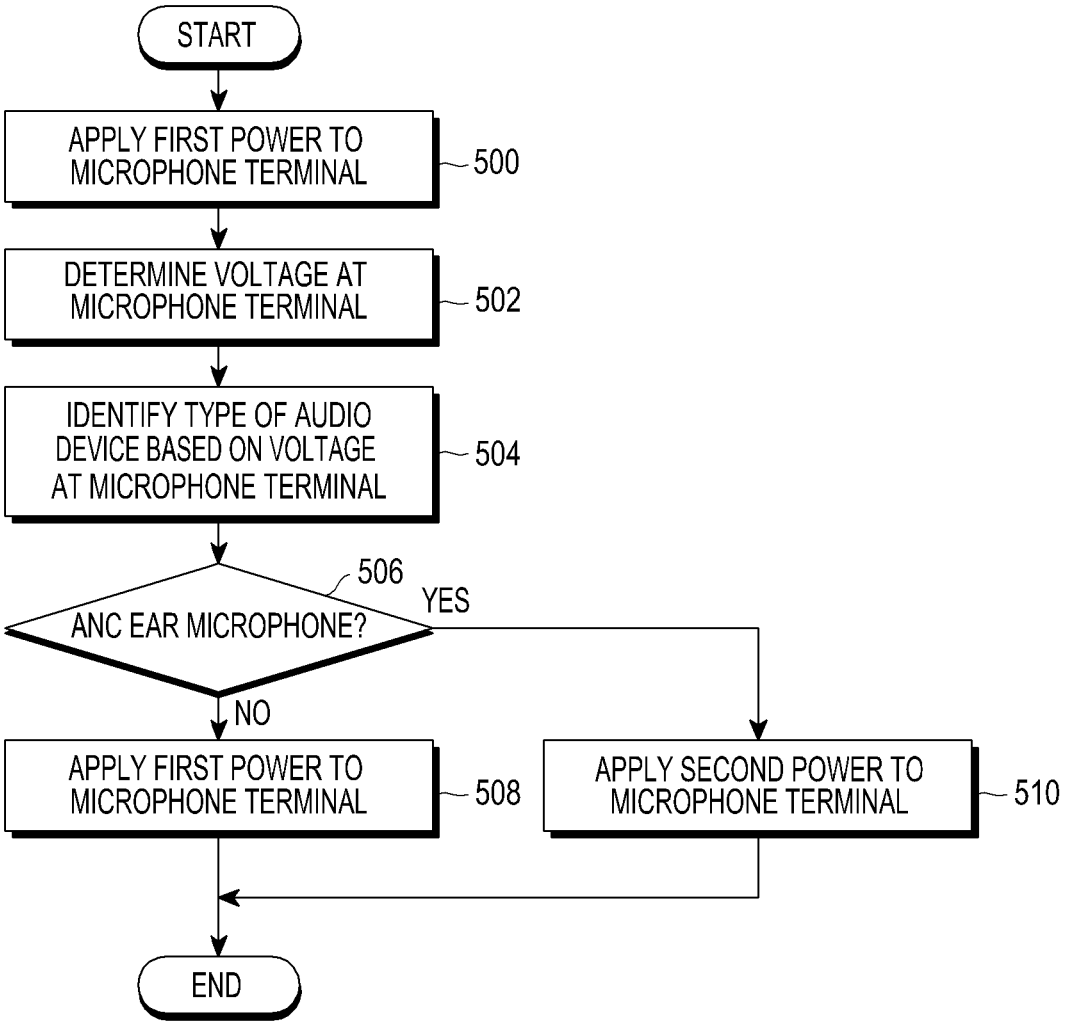
FIG. 5 is a flowchart illustrating a method for supplying power to an audio device from an electronic device according to an embodiment of the present disclosure.

FIG. 5 is a flowchart illustrating a method for supplying power to an audio device from an electronic device according to an embodiment of the present disclosure.

Referring to FIG. 5, for example, once one of the ear microphone 250 of FIG. 2, the ear microphone 300 of FIG. 3, and the earphone 400 of FIG. 4 is connected to the electronic device 200 shown in FIGS. 2 to 4, the electronic device 200 operates the power unit 218 and controls the switch 220 to apply output power of the power unit 218 to the microphone terminal 216 through the resistor 222 as the first power, in operation 500. It is common for the electronic device 200 to recognize whether an audio device, such as an ear microphone or earphone is connected thereto, and thus the associated detailed description will be omitted herein.

In operation 502, the electronic device 200 may determine a voltage at the microphone terminal 216, and in operation 504 the electronic device 200 may identify whether the audio device connected to the electronic device 200 has a type that includes an ANC block.

In operations 506 to 510, the electronic device 200 may apply one of the first power and second power to be supplied to the audio device through the microphone terminal 216 to the microphone terminal 216 based on the type of the audio device.

In operation 506, the electronic device 200 may determine whether the identified type of the audio device is an ANC ear microphone including the ANC block. If the audio device connected to the electronic device 200 has a type that does not include the ANC block, such as the ear microphone 300 of FIG. 3 or the earphone of FIG. 4, in operation 508, the electronic device 200 may apply the first power to the microphone terminal 216. If the type of the audio device connected to the electronic device 200 is an ANC ear microphone that includes the ANC block 254, such as the ear microphone 250 shown in FIG. 2, in operation 510, the electronic device 200 may apply the second power to the microphone terminal 216 instead of the first power. Therefore, the ANC block 254 of the ear microphone 250 may be driven by power input through the microphone terminal 270.

Accordingly, an electronic device 200 may supply the audio device with power corresponding to whether the audio device includes an additional function unit. The electronic device 200 may supply power to drive the additional function unit of the audio device such as the ear microphone 250 to the audio device through the connector 202 of a typical structure. Therefore, the audio device like the ear microphone 250 may drive the additional function unit with the power supplied through a connector of a typical structure without need for a battery to drive the additional function unit.

Furthermore, the electronic device 200 may control whether to drive the additional function unit of the audio device by supplying or stopping supplying the audio device with power corresponding to whether the audio device includes the additional function device.

In operation 510, the electronic device 200 may display an indication that an ANC function is operating by the ANC block 254 of the ear microphone 250 through a display device, such as a display or an indicator of the electronic device 200. In operation 508, the electronic device 200 may stop displaying the indication that the ANC function is operating by the ANC block 254 of the ear microphone 250.

Figure 6:
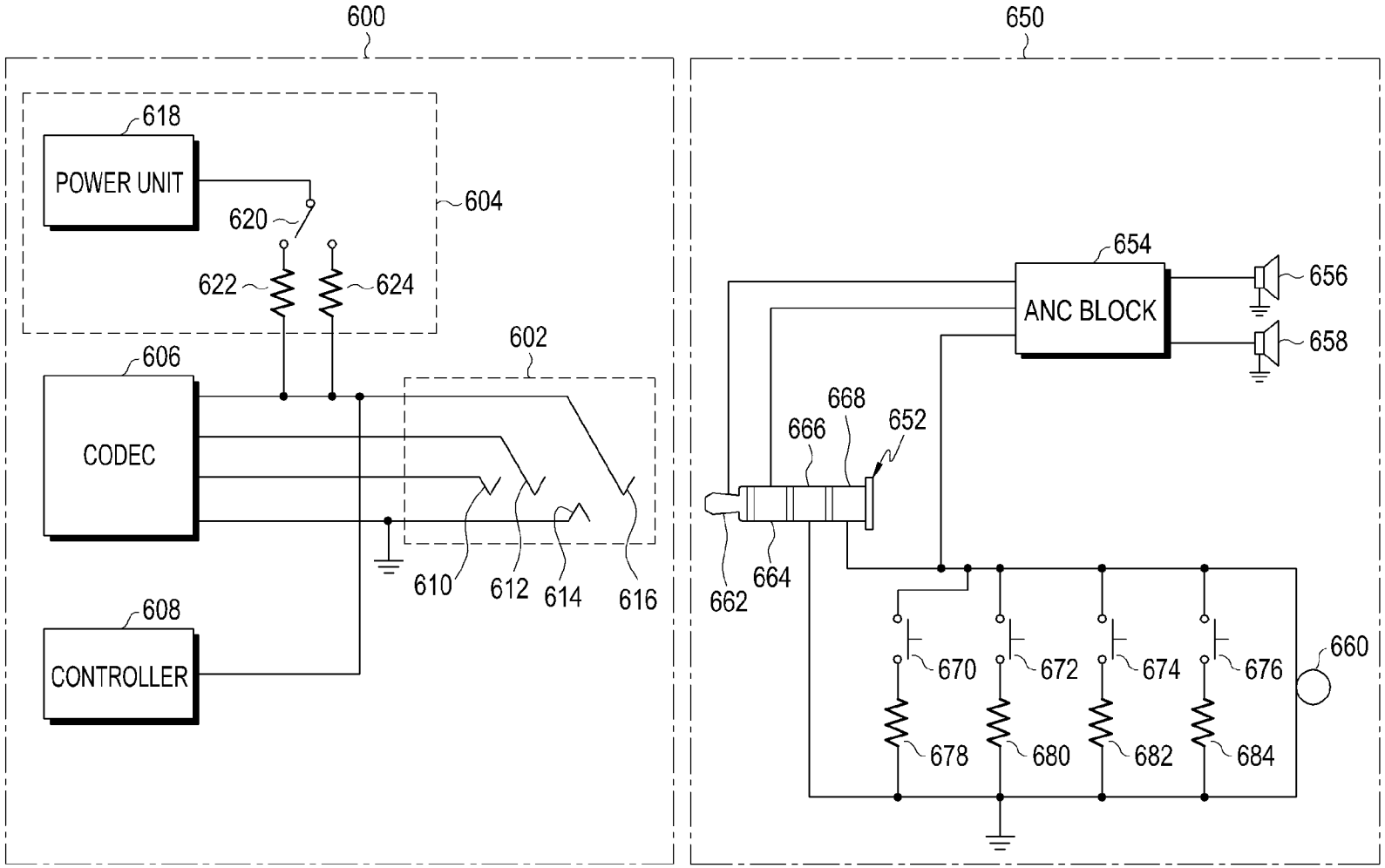
FIG. 6 illustrates a block diagram of a pair of an electronic device and audio device to be connected to each other according to an embodiment of the present disclosure.

FIG. 6 illustrates a block diagram of a pair of an electronic device and audio device to be connected to each other according to an embodiment of the present disclosure.

Referring to FIG. 6, an audio device, for example, an ear microphone 650 may be connected to an electronic device 600. In the embodiment of FIG. 6, the electronic device 600 is connected to the ear microphone 650 through their respective 4-pole connectors each including an L channel audio terminal, an R channel audio terminal, a ground terminal, and a microphone terminal.

The electronic device 600 may include an audio device connector 602, a power supply unit 604, a codec 606, and a controller 608. The ear microphone 650 may include an electronic device connector 652, an ANC block 654, an L channel speaker 656, an R channel speaker 658, a microphone 660, an ANC driving instruction switch 670, a volume up switch 672, a volume down switch 674, a send/end switch 676, and resistors 678, 680, 682 and 684.

The electronic device 600 may correspond to the electronic device 200 shown in FIG. 2. Accordingly, the audio device connector 602, the power supply unit 604, the codec 606, and the controller 608 may also correspond to the audio device connector 202, the power supply unit 204, the codec 206, and the controller 208, respectively. Furthermore, an L channel terminal 610, an R channel terminal 612, a ground terminal 614 and a microphone terminal 616 of the audio device connector 602 may also correspond to the L channel terminal 210, the R channel terminal 212, the ground terminal 214 and the microphone terminal 216 of the audio device connector 202 of FIG. 2, respectively. A power unit 618, a switch 620 and resistors 622 and 624 of the power supply unit 604 may also correspond to the power unit 218, the switch 220 and the resistors 222 and 224 of the power supply unit 204 of FIG. 2, respectively. Thus, the detailed description of the electronic device 600 that overlaps with the electronic device 200 will be omitted herein.

In this embodiment, the ear microphone 650 includes the ANC driving instruction switch 670 in place of the type setup unit 262 included in the ear microphone 250 shown in FIG. 2. Thus, the electronic device connector 652, ANC block 654, L channel speaker 656, R channel speaker 658, microphone 660, volume up switch 672, volume down switch 674, send/end switch 676, and resistors 680, 682 and 684 may correspond to the electronic device connector 252, ANC block 254, L channel speaker 256, R channel speaker 258, microphone 260, volume up switch 272, volume down switch 274, send/end switch 276, and resistors 278, 280 and 282 shown in FIG. 2, respectively. Also, an L channel terminal 662, an R channel terminal 664, a ground terminal 666 and a microphone terminal 668 of the electronic device connector 652 may correspond to the L channel terminal 264, the R channel terminal 266, the ground terminal 268 and the microphone terminal 270 of the electronic device connector 252 of FIG. 2, respectively. Thus, the detailed description of the ear microphone 650 that overlaps with the ear microphone 250 will be omitted herein.

The ANC driving instruction switch 670 and the resistor 678 may be connected in series between the microphone terminal 668 and the ground. The ANC driving instruction switch 670 may operate as a driving instruction unit. The driving instruction unit may provide a voltage indicating an instruction as to whether to drive the ANC block 654 to the electronic device 600 through the microphone terminal 668.

The ANC driving instruction switch 670 may be used as an ANC key to instruct the electronic device 600 whether to drive the ANC block 654. The ANC driving instruction switch 670 may be an automatic reset type push button switch that is turned on if pressed and turned off if released.

The resistor 678 may have different resistance from the resistors 680, 682 and 684. For example, the resistance of the resistor 678 may be 1.2 kΩ, the resistance of the resistor 680 may be 619Ω, the resistance of the resistor 682 may be 221Ω, and the resistance of the resistor 684 may be 50Ω. Accordingly, when the ANC driving instruction switch 670, volume up switch 672, volume down switch 674, and send/end switch 676 are each turned on, a corresponding voltage at the microphone terminal 316 may be different, each other. Therefore, the electronic device 600 may identify a type of a turned-on switch among the ANC driving instruction switch 670, volume up switch 672, volume down switch 674, and send/end switch 676 based on the voltage at the microphone terminal 616.

The controller 608 may identify an instruction as to whether to drive the ANC block 654 included in the ear microphone 650 based on the voltage at the microphone terminal 616. Whenever the ANC driving instruction switch 670 is turned on, a voltage corresponding to the resistor 678 may be input to the controller 608 through the microphone terminal 616 from the ear microphone 650. The controller 608 may recognize the voltage corresponding to the resistor 678 input through the microphone terminal 616 as an ANC key input that instructs whether to drive the ANC block 654. If there is an ANC key input while the ANC block 654 is not driven, the controller 608 may identify the ANC key input as an instruction to drive the ANC block 654, and if there is an ANC key input while the ANC block 654 is driven, the controller 608 may identify the ANC key input as an instruction to stop driving the ANC block 654. If the controller 608 is applying the first power to the microphone terminal 616, the controller 608 may determine that the ANC block 654 is not being driven. If the controller 608 is applying the second power to the microphone terminal 616, the controller 608 may determine that the ANC block 654 is being driven.

The controller 608 may control the power supply unit 604 to supply the microphone terminal 616 with one of the first and second power that corresponds to the instruction as to whether to drive the ANC block 654. In response to the instruction to drive the ANC block 654 from the ear microphone 650, the controller 208 may control the switch 620 to apply output power of the power unit 618 to the microphone terminal 616 through the resistor 624 as the second power. In response to the instruction to stop driving the ANC block 654 from the ear microphone 650, the controller 208 may control the switch 620 to apply output power of the power unit 618 to the microphone terminal 616 through the resistor 622 as the first power.

Figure 7:
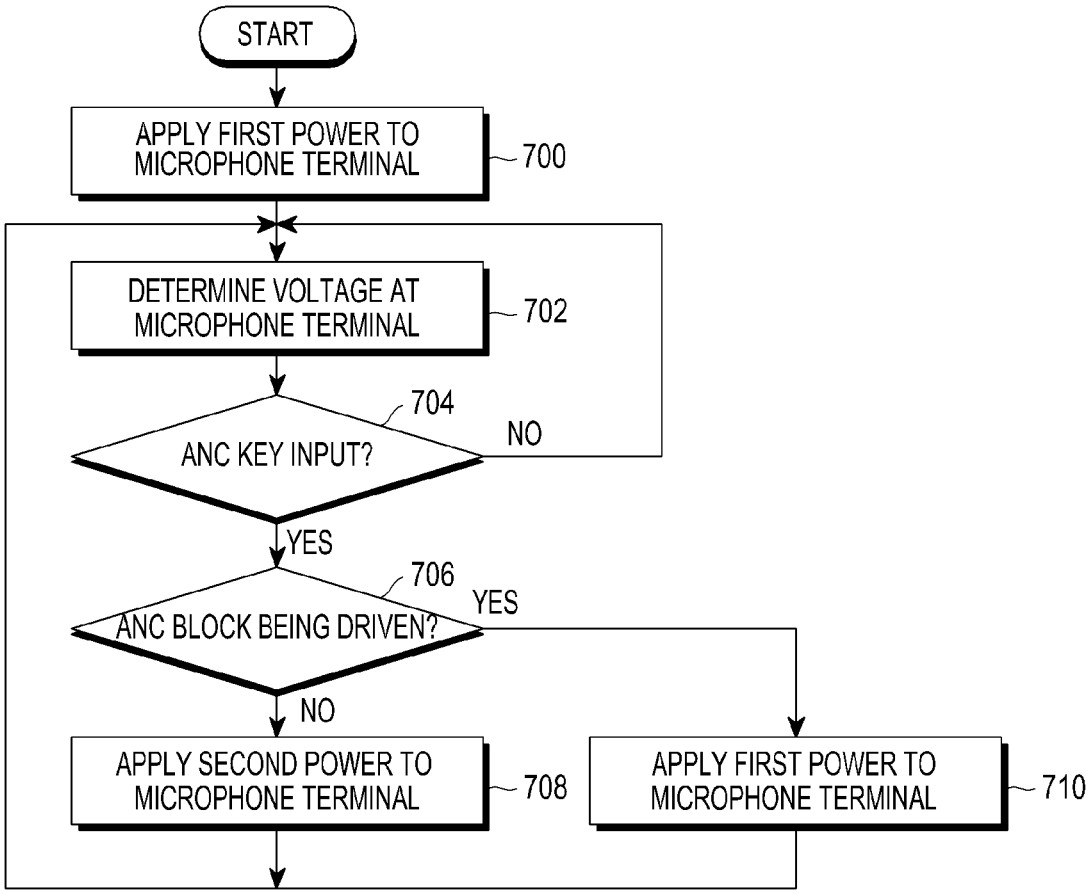
FIG. 7 is a flowchart illustrating a method for supplying power to an audio device from an electronic device according to an embodiment of the present disclosure.

FIG. 7 is a flowchart illustrating a method for supplying power to an audio device from an electronic device according to an embodiment of the present disclosure.

Referring to FIG. 7, once the ear microphone 650 is connected to the electronic device 600, in operation 700, the electronic device 600 may activate the power unit 618 and control the switch 620 to apply output power of the power unit 618 to the microphone terminal 616 through the resistor 622 as the first power.

In operation 702, the electronic device 600 may determine a voltage at the microphone terminal 616, and in operation 704 the electronic device 600 may identify an ANC key input to instruct whether to drive the ANC block 654 based on the voltage at the microphone terminal 616.

If there is the ANC key input, in operation 706, the electronic device 600 may determine whether the ANC block 654 is being driven. If the electronic device 600 is applying the second power to the microphone terminal 616, the electronic device 600 may determine that the ANC block 654 is being driven. If the electronic device 600 is applying the first power to the microphone terminal 616, the electronic device 600 may determine that the ANC block 654 is not being driven.

If the ANC block 654 is not being driven, in operation 708, the electronic device 600 may determine that the ANC key input instructs to drive the ANC block 654 and may drive the ANC block 654 by applying the second power to the microphone terminal 616. If the ANC block 654 is being driven, in operation 710, the electronic device 600 may determine that the ANC key input instructs to stop driving the ANC block 654 and may stop driving the ANC block 654 by applying the first power to the microphone terminal 616 instead of the second power.

Accordingly, the electronic device 600 may control whether to drive the ANC block 654 based on the instruction from the ear microphone 650.

In operation 708, the electronic device 600 may display an indication that an ANC function is operating by the ANC block 654 of the ear microphone 650 through a display device, such as a display or an indicator of the electronic device 600. In operation 710, the electronic device 600 may stop displaying the indication that the ANC function is operating by the ANC block 654 of the ear microphone 650.

Figure 8:
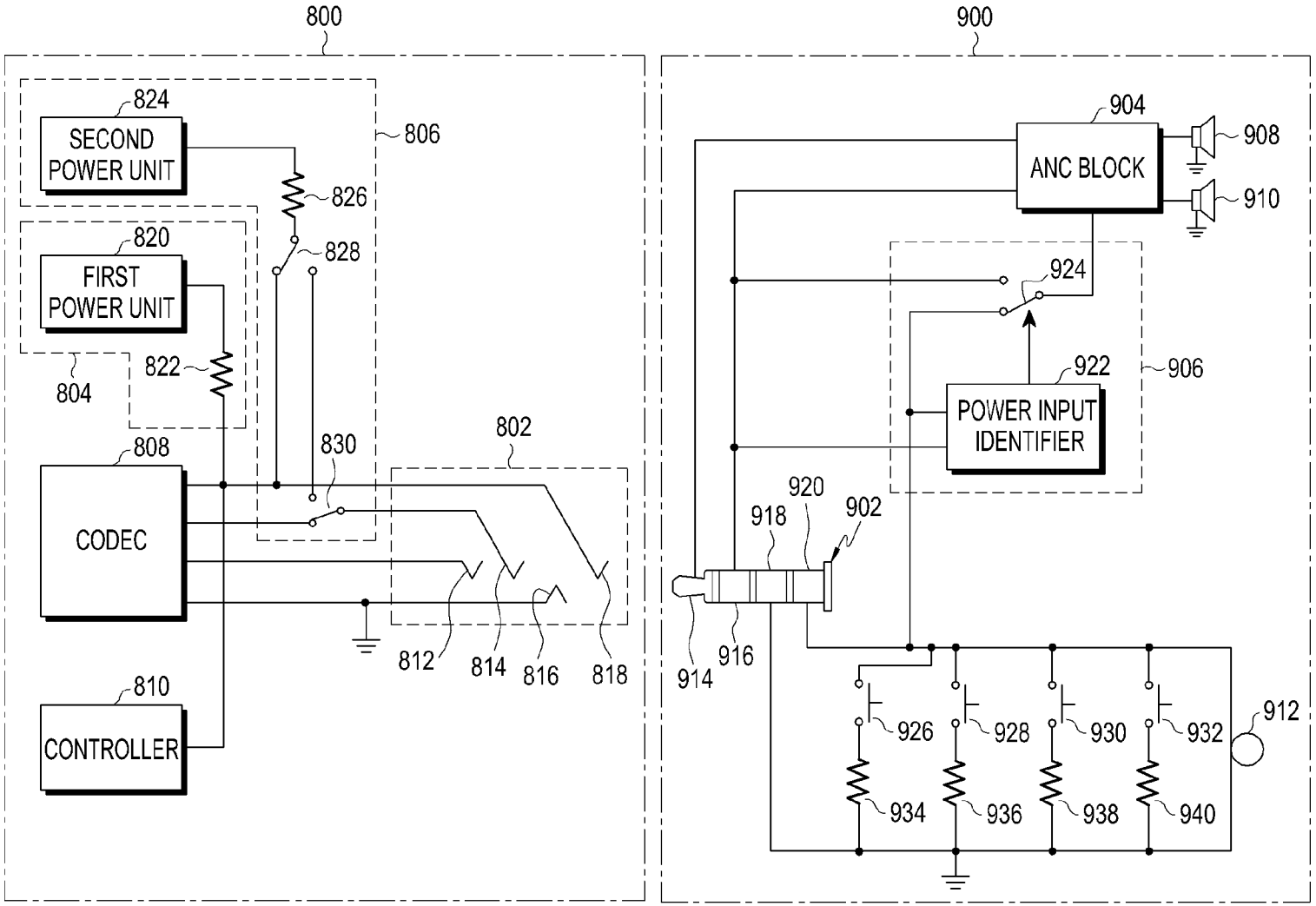
FIGS. 8 and 9 illustrate block diagrams of pairs of an electronic device and audio device to be connected to each other according to an embodiment of the present disclosure.

FIG. 8 illustrates a block diagram of a pair of an electronic device and audio device to be connected to each other according to an embodiment of the present disclosure.

Referring to FIG. 8, an audio device, for example, an ear microphone 900 may be connected to an electronic device 800. In the embodiment of FIG. 8, the electronic device 800 is connected to the ear microphone 900 through their respective 4-pole connectors each including an L channel audio terminal, an R channel audio terminal, a ground terminal, and a microphone terminal.

The electronic device 800 may include an audio device connector 802, a first power supply unit 804, a second power supply unit 806, a codec 808, and a controller 810. The ear microphone 900 may include an electronic device connector 902, an ANC block 904, a power input unit 906, an L channel speaker 908, an R channel speaker 910, a microphone 912, an ANC driving instruction switch 926, a volume up switch 928, a volume down switch 930, a send/end switch 932, and resistors 934, 936, 938 and 940.

The audio device connector 802 may include an L channel terminal 812, an R channel terminal 814, a ground terminal 816, and a microphone terminal 818. An L channel terminal 812, an R channel terminal 814, a ground terminal 816 and a microphone terminal 818 of the audio device connector 802 may correspond to the L channel terminal 210, the R channel terminal 212, the ground terminal 214 and the microphone terminal 216 of the audio device connector 202 of FIG. 2, respectively. The electronic device connector 902 may include an L channel terminal 914, an R channel terminal 916, a ground terminal 918, and a microphone terminal 920. The L channel terminal 914, R channel terminal 916, ground terminal 918 and microphone terminal 920 of the electronic device connector 902 may correspond to the L channel terminal 264, the R channel terminal 266, the ground terminal 268 and the microphone terminal 270 of the electronic device connector 252 of FIG. 2, respectively.

The terminals 812 to 818 of the audio device connector 802 may be connected to the codec 808. The codec 808 may correspond to the codec 206 shown in FIG. 2. The codec 808 may output an audio signal to the L channel audio terminal 812 and the R channel audio terminal 814 and may receive an audio signal of a microphone from the microphone terminal 818.

The first power supply unit 804 may generate first power to be supplied to the ear microphone 900 through the microphone terminal 818. The second power supply unit 806 may generate second power to be supplied to the ear microphone 900 through one of the microphone terminal 818 and the R channel audio terminal 814. The first power may be used as driving power for the microphone 912, and the second power may be used as driving power for the ANC block 904.

The ANC block 904, L channel speaker 908, R channel speaker 910, microphone 912, ANC driving instruction switch 926, volume up switch 928, volume down switch 930, send/end switch 932, and resistors 934, 936, 938 and 940 of the ear microphone 900 may correspond to the ANC block 654, L channel speaker 656, R channel speaker 658, microphone 660, ANC driving instruction switch 670, volume up switch 672, volume down switch 674, send/end switch 676, and resistors 678, 680, 682 and 684 shown in FIG. 6, respectively. Thus, the detailed description of the ear microphone 900 that overlaps with the ear microphone 650 of FIG. 6 will be omitted herein.

The controller 810 may correspond to the controller 608 shown in FIG. 6. The controller 810 may identify an instruction as to whether to drive the ANC block 904 included in the ear microphone 900 based on the voltage at the microphone terminal 818. Whenever the ANC driving instruction switch 926 is turned on, a voltage corresponding to the resistor 934 may be input to the controller 810 through the microphone terminal 818 from the ear microphone 900. The controller 810 may recognize the voltage corresponding to the resistor 934 input through the microphone terminal 818 as an ANC key input that instructs whether to drive the ANC block 904. If there is an ANC key input while the ANC block 904 is not driven, the controller 810 may identify the ANC key input as an instruction to drive the ANC block 904, and if there is an ANC key input while the ANC block 904 is driven, the controller 608 may identify the ANC key input as an instruction to stop driving the ANC block 904. If the controller 810 is applying the first power to the microphone terminal 818, the controller 810 may determine that the ANC block 904 is not being driven. If the controller 810 is applying the second power to the microphone terminal 814 or the R channel audio terminal 814, the controller 810 may determine determined that the ANC block 904 is being driven.

The controller 810 may control the second power supply unit 806 to supply the second power to one of the microphone terminal 818 and the R channel audio terminal 814 in response to the instruction to drive the ANC block 904.

The first power supply unit 804 may include a first power unit 820 and a resistor 822. The first power supply unit 804 may generate the first power under control of the controller 810. The first power unit 820 may be a power converter, such as an LDO that generates power from a battery source of the electronic device 800. The resistor 822 may be connected between an output of the first power unit 820 and the microphone terminal 818.

The second power supply unit 806 may include a second power unit 824, a resistor 826, and switches 828 and 830. The second power supply unit 806 may generate the second power under control of the controller 810. The second power unit 824 may be a power converter, such as an LDO that generates power from a battery source of the electronic device 800. The switch 828 may receive output power of the second power unit 824 through the resistor 826 and apply the power to one of the microphone terminal 818 and the switch 830. The switch 830 may apply one of power input from the switch 828 and an R channel audio signal input from the codec 808 to the R channel audio terminal 814.

The resistor 822 may have higher resistance than the resistor 826 does. The resistor 822 may have resistance corresponding to a consumption current of the microphone 912. The resistor 826 may have resistance corresponding to a consumption current of the ANC block 904. For example, the resistance of the resistor 822 may be 2.2 kΩ and the resistance of the resistor 826 may be 100Ω. Accordingly, the first power has higher current than the second power does.

The controller 810 may determine whether the electronic device 800 is in an active microphone state in response to an instruction to drive the ANC block 904. The active microphone state may be state where the microphone 912 may be allowed to be used, for example, during calling, voice recording, voice recognition, etc. If it is not in the active microphone state, it means that the microphone 912 is not being used, for example, while multimedia content like a song is reproduced. The controller 810 may control the second power supply unit 806 to apply the second power to the microphone terminal 818 if it is not in the active microphone state. The controller 810 may control the second power supply unit 806 to apply the second power to the R channel audio terminal 814 if it is in the active microphone state.

In response to the instruction to drive the ANC block 904 while not in the active microphone state, the controller 810 may control the switches 828 and 830 to apply output power of the second power unit 824 to the microphone terminal 818 through the resistor 826 and the switch 828 as the second power. In response to the instruction to drive the ANC block 904 while in the active microphone state, the controller 810 may control the switches 828 and 830 to apply output power of the second power unit 824 to the R channel audio terminal 814 through the resistor 826, the switch 828 and the switch 830 as the second power.

In the ear microphone 900, the R channel audio terminal 916, the microphone terminal 920, and the ANC block 904 may all be connected to the power input unit 906. The power input unit 906 may apply power input through a terminal at which a voltage above a set level is detected among the R channel audio terminal 916 and the microphone terminal 920 to the ANC block 904 as driving power.

The power input unit 906 may include a power input identifier 922 and a switch 924. The power input identifier 922 may identify a terminal at which a voltage higher than the set level is detected among the R channel audio terminal 916 and the microphone terminal 920. The switch 924 may apply power input through a terminal identified by the power input identifier 922 among the R channel audio terminal 916 and the microphone terminal 920 to the ANC block 904 as driving power.

In the embodiment of FIG. 8, the controller 810 controls the second power supply unit 806 to apply the second power to the microphone terminal 818 while the electronic device 800 is not in the active microphone state. The switch 828 may apply the second power input through the resistor 826 from the second power unit 824 to the microphone terminal 818. Therefore, the switch 924 of the ear microphone 900 may apply the second power input through the microphone terminal 920 to the ANC block 904 as driving power.

Figure 9:
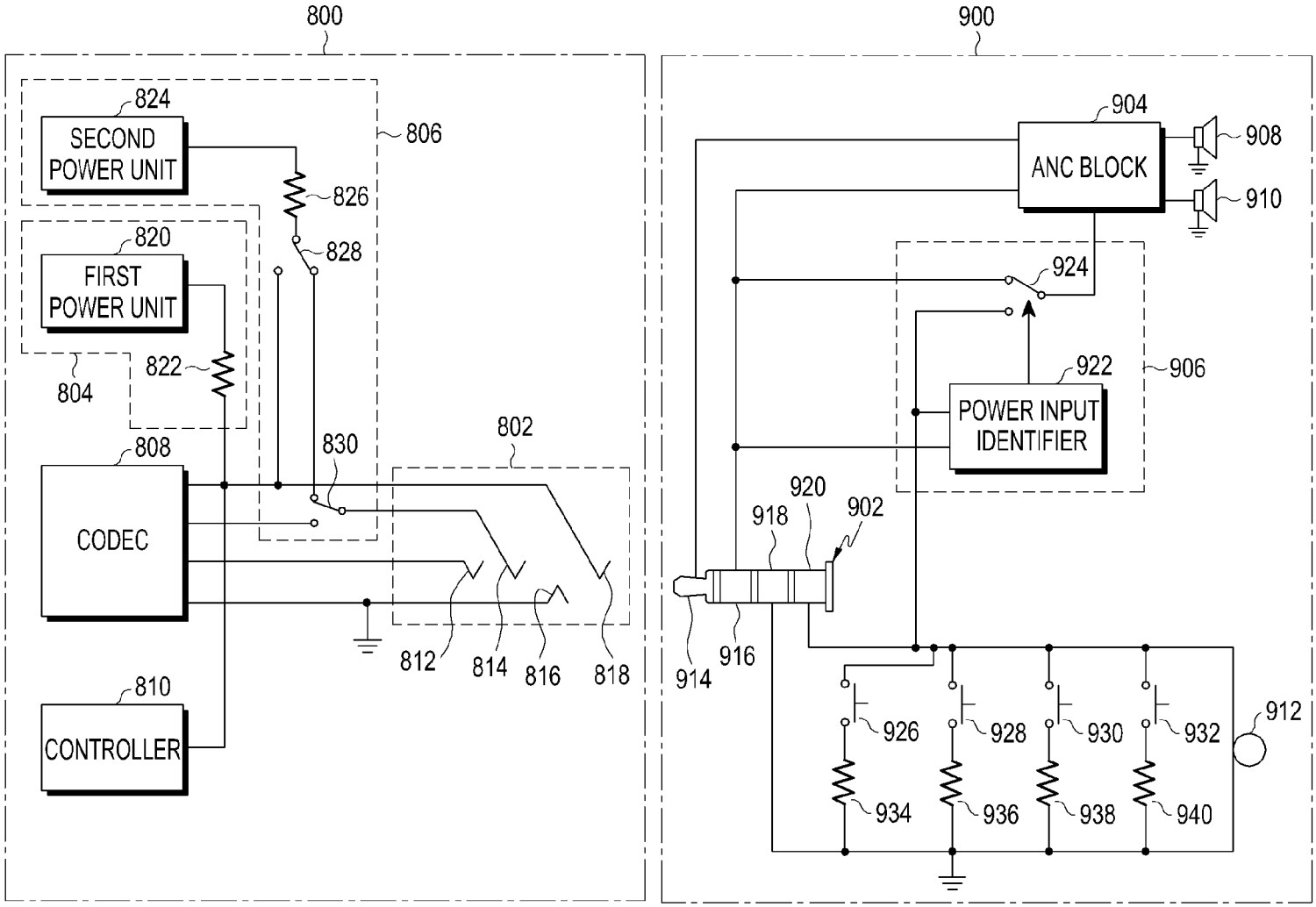

FIG. 9 illustrates a block diagram of a pair of an electronic device and audio device to be connected to each other according to an embodiment of the present disclosure.

Referring to FIG. 9, configurations of the electronic device 800 and ear microphone 900 may be the same as those of FIG. 8. However, FIG. 9 illustrates an occasion where the controller 810 controls the second power supply unit 806 to apply the second power to the R channel audio terminal 814 while the electronic device 800 is in the active microphone state. The switch 828 may apply the second power input through the resistor 826 from the second power unit 824 to the R channel audio terminal 814 instead of the R channel audio signal. Therefore, the switch 924 of the ear microphone 900 may apply the second power input through the R channel audio terminal 916 to the ANC block 904 as driving power.

Figure 10:
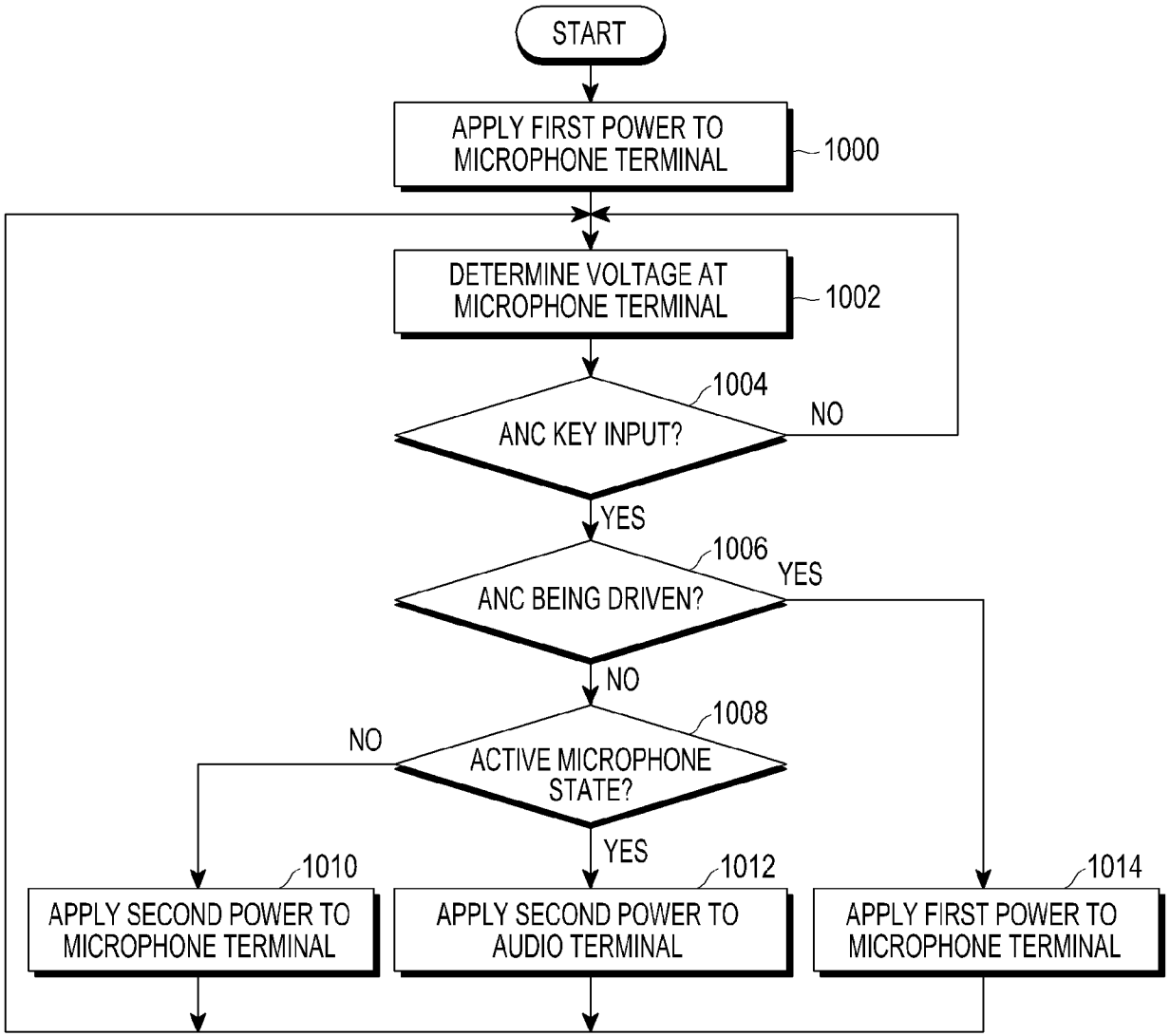
FIG. 10 is a flowchart illustrating a method for supplying power to an audio device from an electronic device according to an embodiment of the present disclosure.

FIG. 10 is a flowchart illustrating a method for supplying power to an audio device from an electronic device according to another embodiment of the present disclosure.

Referring to FIG. 10, once the ear microphone 900 is connected to the electronic device 800, in operation 1000, the electronic device 800 may activate the first power unit 820 to apply output power of the first power unit 820 to the microphone terminal 818 through the resistor 822 as the first power.

In operation 1002, the electronic device 800 may determine a voltage at the microphone terminal 818, and in operation 1004 the electronic device 800 may identify an ANC key input to instruct whether to drive the ANC block 904 based on the voltage at the microphone terminal 818.

If there is the ANC key input, in operation 1006, the electronic device 800 may determine whether the ANC block 904 is being driven. If the electronic device 800 is applying the second power to the R channel audio terminal 814 or the microphone terminal 818, the electronic device 800 may determine that the ANC block 904 is being driven. If the electronic device 800 is applying the first power to the microphone terminal 818, the electronic device 800 may determine that the ANC block 904 is not being driven.

If the ANC block 904 is not being driven, the electronic device 800 may determine that the ANC key input instructs to drive the ANC block 904, and may determine whether it is in the active microphone state in operation 1008. If it is not in the active microphone state, in operation 1010, the electronic device 800 may control the second power supply unit 806 to apply the second power to the microphone terminal 818 as shown in FIG. 8, thereby driving the ANC block 904. If it is in the active microphone state, in operation 1012, the electronic device 800 may control the second power supply unit 806 to apply the second power to the R channel audio terminal 814 as shown in FIG. 9, thereby driving the ANC block 904. Accordingly, even while the microphone 912 is used, the ANC block 904 may be driven.

If the ANC block 904 is being driven in operation 1006, the electronic device 800 may determine that the ANC key input instructs to stop driving the ANC block 904 and may stop applying the second power to the microphone terminal 818 or the R channel audio terminal 814 but apply the first power to the microphone terminal 818, thereby stopping driving the ANC block 904 in operation 1014.

In operations 1010 and 1012, the electronic device 800 may display an indication that an ANC function is operating by the ANC block 904 of the ear microphone 900 through a display device, such as a display or an indicator of the electronic device 800. In operation 1014, the electronic device 900 may stop displaying the indication that the ANC function is operating by the ANC block 904 of the ear microphone 900 when applying the first power to the microphone terminal 818.

While the description in connection with FIGS. 8 to 10 takes an example of applying the second power to the microphone 900 through the R channel audio terminal 814, it would be obvious to one of ordinary skill in the art that the power may be applied to the ear microphone 900 through the L channel audio terminal 812 instead of the R channel audio terminal 814 in the similar way.

Figure 11:
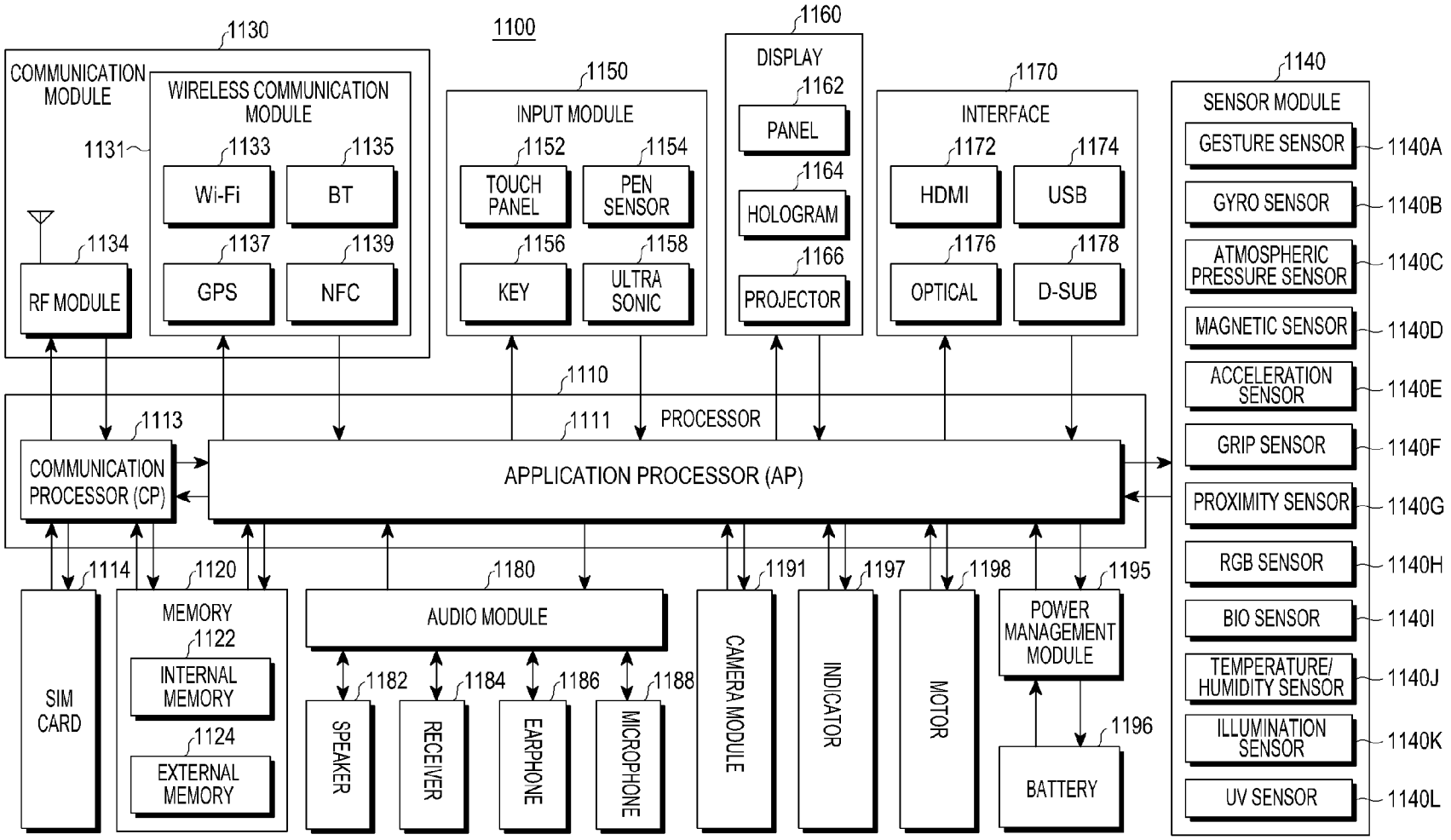
FIG. 11 illustrates a detailed block diagram of an electronic device according to an embodiment of the present disclosure.

FIG. 11 illustrates a detailed block diagram of an electronic device 1100 according to an embodiment of the present disclosure. The electronic device 1100 may constitute the entire or some of the electronic device 102 shown in FIG. 1.

Referring to FIG. 11, the electronic device 1100 may include one or more processors 1110, a Subscriber Identification Module (SIM) card 1114, a memory 1120, a communication module 1130, a sensor module 1140, an input module 1150, a display 1160, an interface 1170, an audio module 1180, a camera module 1191, a power management module 1195, a battery 1196, an indicator 1197, or a motor 1198, but is not limited thereto.

The processor 1110 may include one or more Application processors (APs) 1111 or one or more Communication Processors (CPs) 1113. The processor 1110 may correspond to the processor 120 shown in FIG. 1. While the AP 1111 and CP 1113 are both included in the processor 1110 in the embodiment of FIG. 11, each of the AP 1111 and CP 1113 may be included in a different IC package. In an embodiment, the AP 1111 and CP 1113 may be included in a single IC package.

The AP 1111 may control a plurality of hardware and software elements connected to the AP 1111 by running an operating system or application programs, and perform various data processing and operation. The AP 1111 may be implemented in for example, a System on Chip (SoC). In accordance with an embodiment, the processor 1110 may further include a Graphic Processing Unit (GPU).

The CP 1113 may manage data links in communication among different electronic devices over a network, and perform communication protocol conversion. The CP 1113 may be implemented in for example, an SoC. In an embodiment, the CP 1113 may perform at least a part of a multimedia control function. The CP 1113 may also identify and authenticate the electronic device 1100 in the communication network for example, by means of the SIM card 1114. The CP 1113 may also provide a voice call service, a video call service, a text messaging service and/or a packet data service to the user.

Furthermore, the CP 1113 may control data communication of the communication module 1130. While in the embodiment of FIG. 11, some components like the CP 1113, power management module 1195, or memory 1120 are each illustrated to be a separate component, the AP 1111 may include at least one of the components (e.g., CP 1113) in another embodiment.

In accordance with an embodiment, the AP 1111 or the CP 1113 may load a command or data received from at least one of a non-volatile memory or other components connected to the AP 1111 or the CP 1113, and then process the command or data. In addition, the AP 1111 or the CP 1113 may store data received from at least one of the other components or generated by at least one of the other components in a non-volatile memory.

The SIM card 1114 may include a subscriber identification module, and may be inserted into a slot formed in a particular position in the electronic device 1100. The SIM card 1114 may include a unique identification information, such as Integrated Circuit Card Identifier (ICCID), or subscriber information, such as International Mobile Subscriber Identity (IMSI).

The memory 1120 may include an internal memory 1122 and/or an external memory 1124. The memory 1120 may correspond to the memory 130 shown in FIG. 1. The internal memory 1122 may include at least one of a volatile memory, such as Dynamic Random Access Memory (DRAM), Static RAM (SRAM), Synchronous Dynamic RAM (SDRAM), or the like, or a non-volatile memory, such as One Time Programmable Read Only Memory (OTPROM), Programmable ROM (PROM), Erasable and Programmable ROM (EPROM), Electrically Erasable and Programmable ROM (EEPROM), mask ROM, flash ROM, NAND flash memory, NOR flash memory, or the like. In an embodiment, the internal memory 1122 may be a Solid State Drive (SSD). The external memory 1124 may include a flash drive, such as compact flash (CF), Secure Digital (SD), Micro Secure Digital (Micro-SD), Mini Secure Digital (Mini-SD), extreme Digital (xD), memory stick, or the like. The external memory 1124 may be operationally connected to the electronic device 1100 through various interfaces.

Although not shown, the electronic device 1100 may further include a storage device (or a storage medium), such as a hard drive.

The communication module 1130 may include a wireless communication module 1131 or a Radio Frequency (RF) module 1134. The communication module 1130 may be included in, for example, the communication interface 160 shown in FIG. 1. The wireless communication module 1131 may include any of Wi-Fi 1133, Bluetooth (BT) 1135, Global Positioning System (GPS) 1137, or Near Field Communication (NFC) 1139. For example, the wireless communication module 1131 may provide a wireless communication function with wireless frequencies. Additionally or alternatively, the wireless communication module 1131 may include a network interface (e.g., a Local Area Network (LAN) card) or a modem for connecting the electronic device 1100 to a network (e.g., Internet, LAN, Wireless Area Network (WAN), communication network, cellular network, satellite network, or Plain Old Telephone Service (POTS)).

The RF module 1134 may process transmission/reception of voice or sound. The RF module 1134 may include, for example, a transceiver, a Power Amp Module (PAM), a frequency filter, or a Low Noise Amplifier (LNA) (not shown). The RF module 1134 may further include some parts for wireless communication, i.e., for transmitting or receiving RF signals over the air, such as conductors, wires, etc.

The sensor module 1140 may include at least one of a gesture sensor 1140A, a gyro sensor 1140B, an atmospheric pressure sensor 1140C, a magnetic sensor 1140D, an acceleration sensor 1140E, a grip sensor 1140F, a proximity sensor 1140G, an RGB (Red, Green, Blue) sensor 1140H, a bio sensor 1140I, a temperature/humidity sensor 1140J, an illumination sensor 1140K or an Ultra Violet (UV) sensor 1640L, and Infrared (IR) sensor (not shown). The sensor module 1140 may measure a physical quantity or convert information measured or detected by monitoring the electronic device 1100 to an electric signal. Additionally or alternatively, the sensor module 1140 may include an E-nose sensor, an ElectroMyoGraphy (EMG) sensor, an ElectroEncephaloGram (EEG) sensor, an ElectroCardioGram (ECG) sensor, or a finger print sensor, or the like.

The sensor module 1140 may further include a control circuit for controlling at least one or more of the sensors included in the sensor module 1140.

The input module 1150 may include a touch panel 1152, a (digital) pen sensor 1154, a key 1156, or an ultrasonic input device 1158. The input module 1150 may be included in the I/O interface 140 shown in FIG. 1. The touch panel 1152 may recognize touch inputs in at least one of capacitive, resistive, infrared, or ultrasonic methods. The touch panel 1152 may further include a controller (not shown). In case of the capacitive method, physical contact or proximity detection may be possible. The touch panel 1152 may further include a tactile layer function. In this regard, the touch panel 1152 may provide the user with a tactile response.

The (digital) pen sensor 1154 may be implemented in a way identical or similar to how a touch input of a user is received, or by using a separate sheet for recognition. The key 1156 may include, for example, a physical button. The key 1156 may further include an optical key, a keypad, or a touch key. The ultrasonic input device 1158 may use an input tool that generates an ultrasonic signal and enable the electronic device 1100 to determine data by sensing the ultrasonic signal to a microphone (for example, the microphone 1188), thereby enabling wireless recognition. In an embodiment, the electronic device 1100 may receive a user input from an external device, such as a network, a computer or a server through the communication module 1130.

The display 1160 may include a panel 1162, a hologram device 1164, or a projector 1166. The display 1160 may correspond to the display 150 shown in FIG. 1. The panel 1162 may be, any of a Liquid Crystal Display (LCD), Active Matrix Organic Light Emitting Diodes (AMOLEDs), and the like. The panel 1162 may be implemented to be flexible, transparent, or wearable. The panel 1162 may also be incorporated with the touch panel 1152 in a single module. The hologram device 1164 may make three Dimensional (3D) images (holograms) in the air by using light interference. The projector 1166 may render an image onto an external screen by light projection. In accordance with an embodiment, the display 1160 may further include a control circuit to control the panel 1162, the hologram device 1164, or the projector 1166.

The interface 1170 may include for example, a High Definition Multimedia Interface (HDMI) 1172, a Universal Serial Bus (USB) 1174, an optical (communication) interface 1176, or a D-subminiature (D-sub) interface 1178. The interface 1170 may be included in the communication interface 160 shown in FIG. 1. Additionally or alternatively, the interface 1170 may include a Mobile High-definition Link (MHL) interface, a Secure Digital (SD)/MultiMedia Card (MMC) interface, or IrDA standard interface.

The audio module 1180 may convert sound to electrical signals or electrical signals to sound. The audio module 1180 may be included in the I/O interface 140 shown in FIG. 1. The audio module 1180 may process sound information input or output through any of a speaker 1182, a receiver 1184, an earphone 1186, or a microphone 1188. In addition to the earphone 1186, any audio device such as an ear microphone, a headphone, and a headset may be connected to the audio module 1180.

The camera module 1191 may be a device for capturing images and videos, and may include, in an embodiment, one or more image sensors (e.g., front and back sensors), a lens, an Image Signal Processor (ISP), or a flash such as an LED or xenon lamp.

The power management module 1195 may manage power of the electronic device 1100. Although not shown, a Power Management Integrated Circuit (PMIC), a charger IC, or a battery fuel gauge may be included in the power management module 1195.

The PMIC may be mounted on an IC or an SOC. A charging method may be divided into wired and wireless charging methods. The charger IC may charge a battery and prevent overvoltage or overcurrent from being induced from a charger. In an embodiment, the charger IC may be used in at least one of a wired charging scheme and a wireless charging scheme. The wireless charging scheme may include a magnetic resonance scheme, a magnetic induction scheme, or an electromagnetic wave based scheme, and an additional circuit, such as a coil loop, a resonance circuit, a rectifier, or the like may be added for wireless charging.

The battery fuel gauge may measure an amount of remaining power of the battery 1196, a voltage, a current, or a temperature while the battery 1196 is being charged. The battery 1196 may save electricity and supply power. The battery 1196 may include a rechargeable battery or a solar battery.

The indicator 1197 may indicate a particular state of the electronic device 1100 or a part of the electronic device (e.g., the AP 1111), the particular state including for example, a booting state, a message state, or charging state. The motor 1198 may convert electric signals to mechanical vibration.

Although not shown, a processing unit for supporting mobile TV, such as a GPU may be included in the electronic device 1100. The processing unit for supporting mobile TV may process, for example, media data conforming to a standard for Digital Multimedia Broadcasting (DMB), Digital Video Broadcasting (DVB), or media flow.

Each of the aforementioned components of the electronic device may include one or more parts, and a name of the part may vary with a type of the electronic device. The electronic device in accordance with various embodiments of the present disclosure may include at least one of the aforementioned components, omit some of them, or include other additional component(s). Some of the components may be combined into an entity, but the entity may perform the same functions as the components may do.

The term 'module' may refer to a unit including one of hardware, software, and firmware, or a combination thereof. The term 'module' may be interchangeably used with a unit, logic, logical block, component, or circuit. The module may be a minimum unit or part of an integrated component. The module may be a minimum unit or part of performing one or more functions. The module may be mechanically or electrically implemented. For example, the module may include at least one of Application Specific Integrated Circuit (ASIC) chips, Field Programmable Gate Arrays (FPGAs), or Programmable Logic Arrays (PLAs) that perform some operations, which have already been known or will be developed in the future.

At least a part of the device (e.g., modules or their functions) or method (e.g., operations) may be implemented as instructions stored in a computer-readable storage medium in the form of a programming module. The instructions, when executed by one or more processor (e.g., the processor 120), may cause the processor to carry out a corresponding function. The computer-readable storage medium may be the memory 130. At least a part of the programming module may be implemented by the processor 120. At least a part of the programming module may include a module, program, routine, set of instructions, process, and the like for performing one or more functions.

The computer-readable storage medium may include a hardware device configured to store and perform program instructions (e.g., programming module), such as magnetic media such as hard discs, floppy discs, and magnetic tapes, optical media such as Compact Disc ROMs (CD-ROMs) and Digital Versatile Discs (DVDs), magneto-optical media such as floptical disks, ROMs, RAMs, Flash Memories, and/the like. Examples of the program instructions may include not only machine language codes but also high-level language codes which are executable by various computing means using an interpreter. The aforementioned hardware devices may be configured to operate as one or more software modules to carry out various embodiments of the present disclosure, and vice versa.

The electronic device in accordance with the various embodiments of the present disclosure may receive and store a program that includes instructions from a program provider connected wirelessly or by wire for the electronic device to perform the method for supplying power, and the program provider may be the external electronic device or the server as shown in FIG. 1. The program provider may include a memory for storing the program, a communication module for performing wired or wireless communication with the electronic device, and a processor for sending the program to the electronic device automatically or upon request of the electronic device.

Modules or programming modules in accordance with various embodiments of the present disclosure may include at least one or more of the aforementioned components, omit some of them, or further include other additional components. Operations performed by modules, programming modules or other components in accordance with various embodiments of the present disclosure may be carried out sequentially, simultaneously, repeatedly, or heuristically. Furthermore, some of the operations may be performed in a different order, or omitted, or include other additional operation(s).

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An electronic device comprising:

an audio device connector comprising:

a microphone terminal configured to receive an audio signal of a microphone from an audio device, at least one audio terminal configured to output the audio signal to the audio device, and a ground terminal;

a power supply unit having a switch, a first resistor and a second resistor, and configured to selectively generate one of a first power and a second power to be supplied to the audio device through the microphone terminal; and at least one processor configured to:

identify whether the audio device has a type that includes an additional function unit based on a voltage at the microphone terminal, and control the switch of the power supply unit to apply one of the first power through the first resistor and the second power through the second resistor to the microphone terminal correspondingly to the type of the audio device, wherein the first resistor has a resistance value corresponding to a consumption current of the microphone, and wherein the second resistor has a resistance value corresponding to a consumption current of the additional function unit.

2. The electronic device of claim 1, wherein the at least one processor is further configured to:

control the power supply unit to apply the first power to the microphone terminal if the audio device has a type that does not include the additional function unit, and control the power supply unit to apply the second power to the microphone terminal if the audio device has a type that includes the additional function unit.

3. A method for supplying power to an audio device in an electronic device, the method comprising:

identifying whether the audio device has a type that includes an additional function unit based on a voltage at a microphone terminal for receiving an audio signal of a microphone from the audio device; and controlling a switch of a power supply unit to apply one of a first power through a first resistor and a second power through a second resistor, to be supplied to the audio device, to the microphone terminal correspondingly to the type of the audio device, wherein the first resistor has a resistance value corresponding to a consumption current of the microphone, and wherein the second resistor has a resistance value corresponding to a consumption current of the additional function unit.

4. The method of claim 3, wherein the controlling of the switch of the power supply unit to apply one of the first power and the second power to the microphone terminal comprises:

applying the first power to the microphone terminal if the audio device has a type that does not include the additional function unit; and applying the second power to the microphone terminal if the audio device has a type that includes the additional function unit.

5. The method of claim 3, further comprising, when the additional function unit is performing an additional function, indicating on a display that the additional function is being performed.

6. An audio device comprising:

an electronic device connector comprising:

a microphone terminal configured to output an audio signal of a microphone from an electronic device, at least one audio terminal configured to receive the audio signal from the electronic device, and a ground terminal;

an additional function unit configured to be driven by power input from the electronic device through the microphone terminal and perform an additional function; and a type setup unit having a resistor connected between the microphone terminal and ground and configured to provide a voltage indicating that the audio device has a type that includes the additional function unit to the electronic device through the microphone terminal.

7. The audio device of claim 6, wherein the additional function unit includes an Active Noise Canceling (ANC) block.

* * * * *